US007038529B2

(12) United States Patent
Ozeki et al.

(10) Patent No.: US 7,038,529 B2
(45) Date of Patent: May 2, 2006

(54) VOLTAGE STABILIZER

(75) Inventors: Yoshitomo Ozeki, Kawasaki (JP); Hisashige Ando, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/068,761

(22) Filed: Mar. 2, 2005

(65) Prior Publication Data

US 2005/0146378 A1 Jul. 7, 2005

Related U.S. Application Data

(63) Continuation of application No. PCT/JP02/10445, filed on Oct. 8, 2002.

(51) Int. Cl.
*G05F 1/10* (2006.01)

(52) U.S. Cl. ..... 327/538

(58) Field of Classification Search ..... 327/74, 327/77, 80, 81, 88, 89, 309, 315, 316, 530, 327/534, 535, 538, 543, 545, 546
See application file for complete search history.

(56) References Cited

U.S. PATENT DOCUMENTS 5,629,608 A * 5/1997 Budelman ..... 323/268
6,069,521 A 5/2000 Taylor et al.
6,249,112 B1 * 6/2001 Khouri et al. ..... 323/282
6,316,987 B1 * 11/2001 Dally et al. ..... 327/538
6,650,175 B1 * 11/2003 Messager ..... 327/541
6,791,302 B1 * 9/2004 Tang et al. ..... 323/272
6,809,504 B1 * 10/2004 Tang et al. ..... 323/274

FOREIGN PATENT DOCUMENTS

| | | |
|---|---|---|
| EP | 0639886 | 2/1995 |
| JP | 61-153498 | 7/1986 |
| JP | 5-76166 | 3/1993 |
| JP | 8-190436 | 7/1996 |
| JP | 2000-242344 | 9/2000 |

* cited by examiner

*Primary Examiner*—Jeffrey Zweizig
(74) *Attorney, Agent, or Firm*—Staas & Halsey LLP

(57) ABSTRACT

The present invention relates to a voltage stabilizer that stabilizes the voltage of a power supply line on a semiconductor substrate and is intended to provide a voltage stabilizer having a small mounting area on the semiconductor substrate, capable of stabilizing the voltage of the power supply path connecting the power supply and semiconductor substrate. The voltage stabilizer includes a monitoring section 110 connected to the power supply line Vdd that monitors the potential of the power supply line Vdd and outputs a monitor signal indicating the monitoring result and a first current control section 120 that passes a current from the power supply line Vdd according to the monitor signal to stabilize the voltage of the power supply line Vdd, capable of freely passing a current continuously.

4 Claims, 19 Drawing Sheets

VOLTAGE STABILIZER

This application is a continuing application, filed under 35 U.S.C. §111(a), of International Application PCT/JP02/10445, filed Oct. 8, 2002.

TECHNICAL FIELD

The present invention relates to a voltage stabilizer that stabilizes the voltage of a power supply line on a semiconductor substrate.

BACKGROUND ART

A load circuit incorporated in a semiconductor substrate requires a constant voltage to be supplied from a power supply line of a semiconductor substrate and various techniques for supplying a constant voltage are conventionally proposed (e.g., see Patent Document 1). When a voltage of a power supply path which connects a power supply and semiconductor substrate becomes unstable, an electromotive force induced by the inductance of this voltage supply path increases and power supply noise produced on the power supply line in the semiconductor substrate increases. The power supply noise produced on the power supply line must be suppressed because it destabilizes the voltage to be supplied to a load circuit. For this purpose, there are conventionally proposals on techniques of monitoring the potential of the power supply path which connects the power supply and semiconductor substrate, passing an amount of current corresponding to the monitoring result through the power supply path or passing an amount of current corresponding to the monitoring result from the power supply path (e.g., see Patent Document 2). Furthermore, since reducing the inductance of the power supply path leads to suppressing power supply noise, packages of a semiconductor apparatus having long terminals such as DIP (Dual In-line Package) or QFP (Quad Flat Package) are being replaced by packages having short terminals such as BGA (Ball Grid Array) package or LGA (Land Grid Array) package.

However, the actual state of a semiconductor apparatus represented by a processor is that with an improvement in the degree of integration of transistors and speed enhancement of operating frequencies, a variation of current passing through the power supply line in the semiconductor substrate is increasing and the speed of the variation is also increasing. The increase in current variations and increase in the variation speed on the power supply line lead to increase in power supply noise produced on the power supply line, resulting in an excessive counter-electromotive force in the power supply path which connects the power supply and semiconductor substrate. Moreover, with the increase in the degree of integration, the potential supplied from the power supply tends to decrease due to a reduction in power consumption and power supply noise increases notably.

Under such circumstances, even if an attempt is made to stabilize the voltage of the power supply path using the technique described in Patent Document 2, it is not possible to follow up the rate of change of the speed-enhanced current and it is difficult to stabilize the voltage of the power supply path. Furthermore, even if the inductance of the power supply path is reduced by means of a package, the increase in current variation is so notable that it is still difficult to stabilize the voltage of the power supply path.

In addition to the technique described in Patent Document 2 and package technique, various techniques are conventionally adopted to stabilize the voltage of the power supply path, but all these techniques have problems. For example, a semiconductor circuit incorporated in a semiconductor substrate has a parasitic capacitance in the own circuit, and it was possible to confine power supply noise within an allowable range using this parasitic capacitance in the era when the degree of integration of transistors and operating frequency were not so high, but at the present time, it is not possible to confine power supply noise within an allowable range using only this parasitic capacitance and it is becoming a general practice to give a decoupling capacitance by means of a capacitance of a gate oxide film or junction capacitance. However, the degree of integration and speed enhancement of operating frequencies are advancing at a dramatic pace at the present time and it is becoming difficult to confine power supply noise within an allowable range by only giving a decoupling capacitance. Here, it may be possible to increase the size of a semiconductor substrate to increase the parasitic capacitance or decoupling capacitance, but increasing the size of the semiconductor substrate will increase the cost, extend signal lines and produce a delay, which is not desirable.

On the other hand, suppressing a variation in the current flowing through the power supply line in the semiconductor substrate will consequently stabilize the voltage of the power supply path which connects the power supply and semiconductor substrate. Here, the variation in the current flowing through the power supply line and variation in the voltage of the power supply line are mutually correlated, and therefore there is a proposal on a circuit which compensates for a voltage drop of the power supply line (e.g., see Patent Document 3), and in addition, there is also a proposal on a circuit which suppresses a voltage increase in the power supply line.

FIG. 1 conceptually illustrates a circuit that compensates for a voltage drop of the power supply line.

A circuit 800 shown in this FIG. 1 includes a voltage drop detection section 810 connected between a power supply line Vdd and ground line Vss. Furthermore, a charge supply section 820 is disposed between the power supply line Vdd and the ground line Vss and this charge supply section 820 is provided with two capacitors 821, 822 and a changeover switch 823. The two capacitors 821, 822 are switched by the changeover switch 823 between a state in which they are connected in series between the power supply line Vdd and ground line Vss (see the changeover switch 823 indicated by solid lines) and a state in which they are connected in parallel therebetween (see the changeover switch 823 indicated by dotted lines) as indicated by arrows in the figure. The voltage drop detection section 810 detects that the potential of the power supply line Vdd has changed toward the low potential side and outputs a detection signal indicating that the potential has changed toward the low potential side. This detection signal is input to the changeover switch 823. The two capacitors 821, 822 remain connected in parallel between the power supply line Vdd and ground line Vss until immediately before the detection signal is input to the changeover switch 823. When the two capacitors 821, 822 are connected in parallel in this way, the capacitors 821, 822 are charged with power from the power supply line Vdd. When the detection signal is input to the changeover switch 823, the changeover switch 823 changes the connection state of the two capacitors 821, 823 from the parallel connection to the serial connection once and then returns the connection state to the parallel connection again. When the two capacitors 821, 822 are connected in series, the power from the power supply line Vdd is boosted and a current flows into the power supply line Vdd. Such a circuit 800 shown in FIG. 1 is monitoring a potential drop of the power supply line Vdd, and can thereby follow up the rate of change of a speed-enhanced current, but the upper limit of the amount of current that can be passed through the power supply line Vdd is determined by the capacitances of the two capacitors 821, 822.

FIG. 2 conceptually illustrates a circuit that suppresses a voltage increase in the power supply line.

In the circuit 900 shown in this FIG. 2, a monitoring section 910 is connected between the power supply line Vdd and ground line Vss. The monitoring section 910 monitors the potential of the power supply line Vdd and outputs, when the potential of the power supply line Vdd changes toward the high potential side, a monitor signal indicating the variation toward the high potential side. Furthermore, the circuit 900 shown in FIG. 2 is provided with a current control section 920 having a capacitor 921. One end of this capacitor 921 is connected to the power supply line Vdd and a monitor signal output from the monitoring section 910 is input to the other end thereof. The potential at this other end changes according to the monitor signal and a current corresponding to the potential difference between both ends of the capacitor 921 flows through the capacitor 921. When the voltage of the power supply line Vdd increases, a current flows out of the power supply line Vdd and can suppress the voltage increase. Such a circuit 900 shown in FIG. 2 is also monitoring the potential increase of the power supply line Vdd, and can thereby follow up the rate of change of a speed-enhanced current, but the upper limit of the amount of current that can be passed from the power supply line Vdd is determined by the capacitance of the capacitor 921.

As shown above, as the current variation increases, both the circuit 800 shown in FIG. 1 and the circuit 900 shown in FIG. 2 require a correspondingly large capacitor and the mounting area on the semiconductor substrate increases. In the circuit 900 shown in FIG. 2, even when the voltage of the power supply line decreases, the voltage drop seems to be complemented by the power charged into the capacitor 921, but the charge therefor is supplied from the power supply line Vdd through an operational amplifier 911, and therefore it is after all not possible to compensate for the drop of the power supply line Vdd.

(Patent Document 1)

Japanese Patent Laid-Open No. 2000-242344 (pp. -4, FIG. 1)

(Patent Document 2)

Japanese Patent Laid-Open No. 8-190436 (p3, FIG. 2)

(Patent Document 3)

U.S. Pat. No. 6,069,521 (FIG. 4A)

DISCLOSURE OF THE INVENTION

The present invention has been implemented in view of the above described circumstances and it is an object of the present invention to provide a voltage stabilizer having a small mounting area on a semiconductor substrate, capable of stabilizing the voltage in a power supply path connecting the power supply and the semiconductor substrate.

In order to attain the above described object, the voltage stabilizer of the present invention is a voltage stabilizer that stabilizes the voltage of a power supply line on a semiconductor substrate, having:

a monitoring section that monitors the potential of the power supply line and outputs a monitor signal indicating the monitoring result; and a first current control section that stabilizes the voltage of the power supply line by outputting a current corresponding to the monitor signal from the power supply line, capable of freely and continuously passing a current.

According to the voltage stabilizer of the present invention, the current passed by the first current control section from the power supply line can stabilize the voltage of the power supply path connecting the power supply and semiconductor substrate. Furthermore, this first current control section can freely and continuously pass a current and can also be constructed of transistors, etc., which eliminates the necessity for any capacitor having a large area and can thereby reduce the mounting area on the semiconductor substrate.

Furthermore, according to the power supply stabilizer of the present invention, the first current control section preferably amplifies the current of a current signal corresponding to the monitor signal and passes the amplified current from the power supply line.

Providing such a first current control section increases an equivalent capacitance and can output a high current from the power supply line at a time. As a result, it is easier to respond to an increase in a current variation on the power supply line and follow up the rate of change of the speed-enhanced current on the power supply line.

Here, in the voltage stabilizer of the present invention, the monitoring section may also detect a variation in the potential of the power supply line and output a monitor signal indicating the variation.

Furthermore, in monitoring the potential of the power supply line, it is also possible to generate a reference voltage, compare the reference voltage and the voltage of the power supply line and output the difference between the two as a monitor signal, but when the reference voltage is generated, it is conceivable that the reference voltage itself may become unstable due to influences from power supply noise. Providing the monitoring section with a capacitor connected to the power supply line for detecting a potential variation of the power supply line eliminates the necessity for generating the reference voltage and can output a monitor signal indicating an accurate variation.

Furthermore, in the voltage stabilizer of the present invention, the first current control section passes a predetermined reference current when the potential of the power supply line is stable at a predetermined potential and the first current control section may also change the current to be passed from the power supply line to a higher current than the reference current based on the monitor signal when the potential of the power supply line changes toward the high potential side, and changes the current to a current lower than the reference current when the potential of the power supply line changes toward the low potential side.

Such a first current control section can supply an equivalent current to the power supply line and can stabilize the potential of the power supply line even when the potential of the power supply line changes toward the low potential side.

The voltage stabilizer of the present invention may also be provided with a high potential line having a predetermined high potential higher than the potential of the power supply line, the monitoring section may be provided with a first monitoring section that generates a first monitor signal indicating a variation toward the high potential side when the potential of the power supply line changes toward the high potential side and a second monitoring section that generates a second monitor signal indicating a variation toward the low potential side when the potential of the power supply line changes toward the low potential side, the first current control section may output a current corresponding to the first monitor signal from the power supply line, and in addition to the first current control section, the invention may also be provided with a second current control section that passes a current corresponding to the second monitor signal from the high potential line to the power supply line or may also be provided with a high potential line having a predetermined high potential higher than the potential of the power supply line, the monitoring section may generate a monitor signal indicating both a variation in the potential of the power supply line toward the high potential side and a variation toward the low potential side, the first current control section may pass a current corresponding to a monitor signal indicating a variation in the potential toward the high potential side from the power supply line, and in addition to the first current control section, the invention may also be provided with a second current control section that passes a current corresponding to a monitor signal indicating a variation in the potential toward the low potential side from the high potential line to the power supply line.

Since both the first and second modes above are provided with the high potential line, when the potential of the power supply line changes toward the low potential side, it is possible to reliably stabilize the potential of the power supply line. Furthermore, the second mode can reduce the size of the monitoring section.

Furthermore, the voltage stabilizer of the present invention is provided with a high potential generation section that generates a high potential node having a predetermined high potential higher than the potential of the power supply line by boosting power from the power supply line, the monitoring section is provided with a first monitoring section that generates a first monitor signal indicating a variation toward the high potential side when the potential of the power supply line changes toward the high potential side and a second monitoring section that generates a second monitor signal indicating a variation toward the low potential side when the potential of the power supply line changes toward the low potential side, and the first current control section passes a current corresponding to the first monitor signal from the power supply line, and in addition to the first current control section, the invention is preferably provided with a second current control section that passes a current corresponding to the second monitor signal from the high potential node to the power supply line and, for example, the high potential generation section may also be provided with two capacitors between the power supply line and ground line to switch the connection state of the two capacitors between a serial connection between the power supply line and ground line and a parallel connection between the power supply line and ground line based on the monitor signal.

In these modes provided with the high potential generation section, incorporating the high potential generation section in the semiconductor substrate eliminates the necessity for providing the semiconductor substrate with a high potential line having a predetermined high potential higher than the potential of the power supply line besides the power supply line.

Furthermore, in the mode of the voltage stabilizer of the present invention provided with a monitor signal branch section that generates, based on the second monitor signal, a current control signal for controlling a current to be passed by the second current control section from the high potential node through the power supply line, transmits the current control signal to the second current control section, and generates, based on the second monitor signal, a connection state changeover signal for switching the connection state of the two capacitors making up the high potential generation section and transmits the connection state changeover signal to the high potential generation section, the second current control section is preferably provided with a variation promotion circuit that in response to a connection state changeover signal after being branched by the monitor signal branch section, promotes a variation of a current to be passed from the high potential node which varies based on the current control signal through the power supply line, or the high potential generation section is preferably provided with a changeover promotion circuit that in response to the current control signal after being branched by the monitor signal branch section and promotes a changeover speed of the connection state of the capacitors switched based on the connection state changeover signal.

Providing the variation promotion circuit can suppress a leakage current which prevents any variation of the current to be passed from the high potential node to the power supply line and reduce power consumption. Furthermore, providing the changeover promotion circuit can provide the connection state changeover signal with a hysteresis characteristic and stabilize the operation with respect to the connection state changeover signal.

Furthermore, in the voltage stabilizer of the present invention, the voltage stabilizer may also be a semiconductor circuit incorporated in the semiconductor substrate.

By so doing, it is possible to incorporate the voltage stabilizer of the present invention in the process of creating a semiconductor circuit on a semiconductor substrate and improve the production efficiency.

As explained so far, the present invention can provide a voltage stabilizer having a small mounting area on the semiconductor substrate, capable of stabilizing the voltage in a power supply path connecting a power supply and the semiconductor substrate.

BEST MODE FOR CARRYING OUT THE INVENTION

Embodiments of the present invention will be explained below.

First, a voltage stabilizer according to a first embodiment of the present invention will be explained conceptually and then the circuit diagram of the circuit thereof will be explained.

Figure 1:
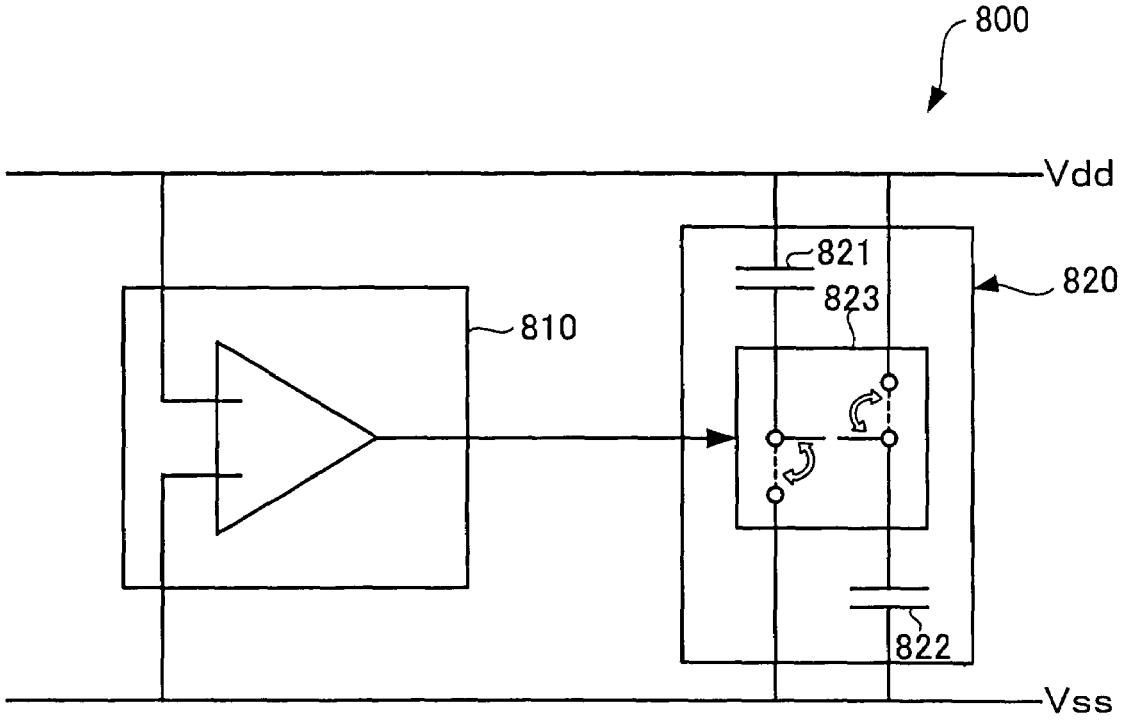
FIG. 1 conceptually illustrates a circuit that compensates for a voltage drop on a power supply line.
Figure 2:
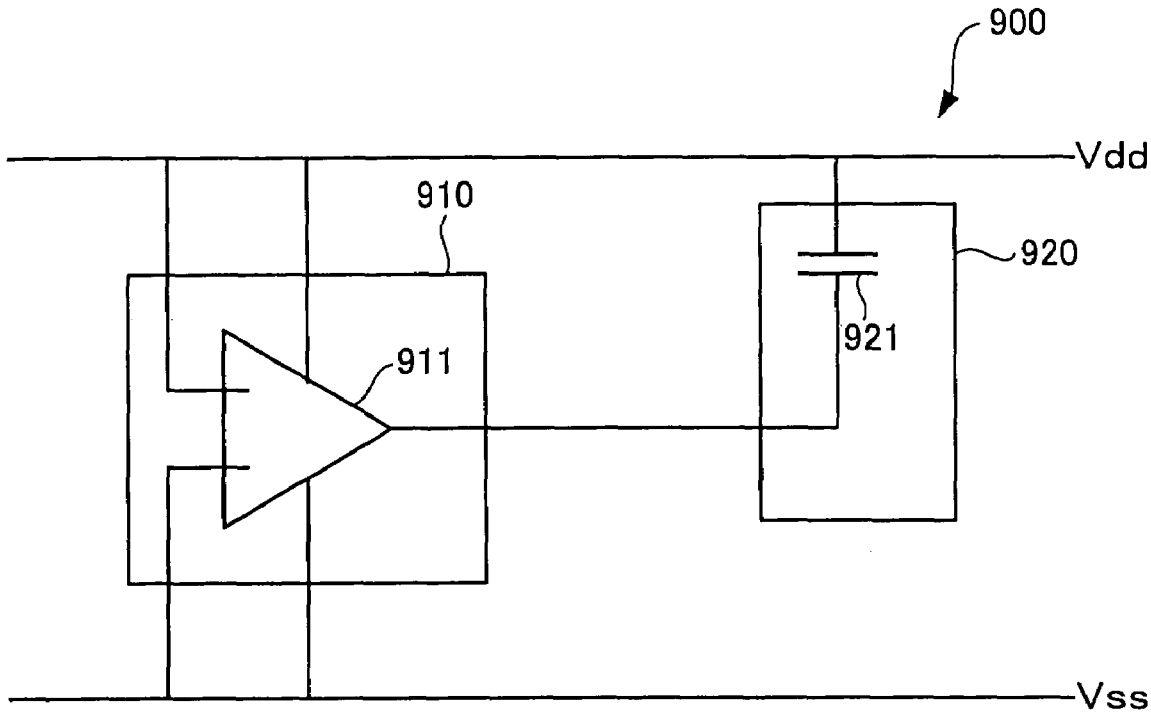
FIG. 2 conceptually illustrates a circuit that compensates for a voltage increase on a power supply line.
Figure 3:
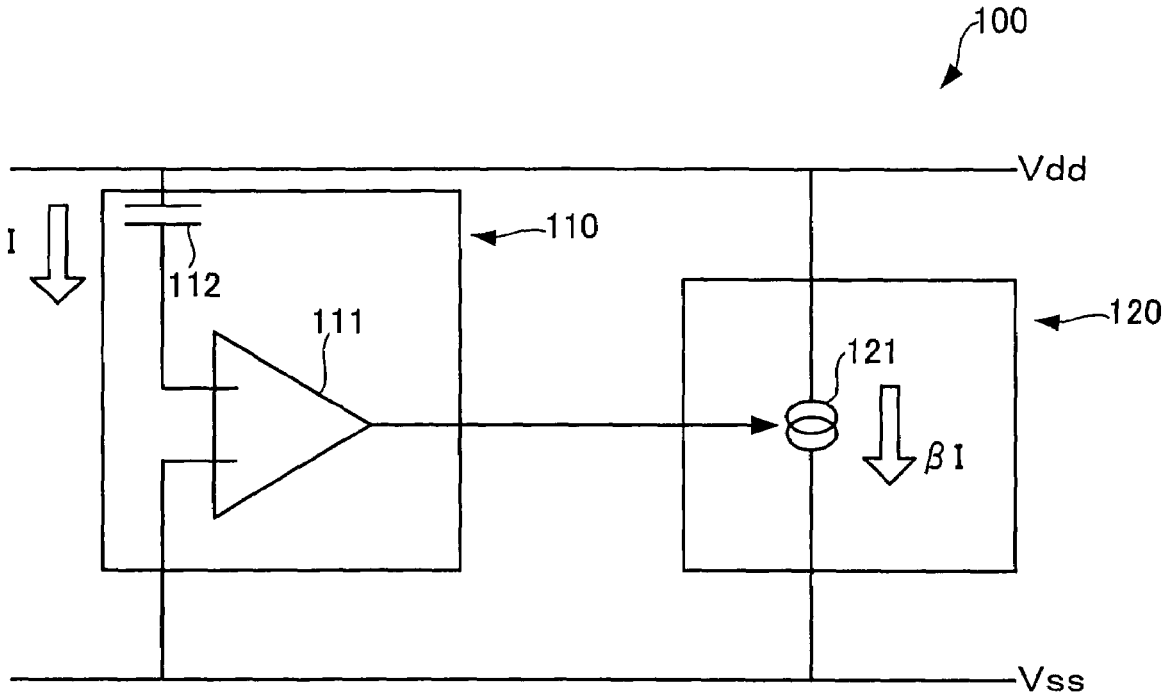
FIG. 3 conceptually illustrates a voltage stabilizer according to a first embodiment.

FIG. 3 conceptually illustrates a voltage stabilizer according to the first embodiment.

The voltage stabilizer 100 shown in this FIG. 3 is a circuit incorporated in a semiconductor substrate and provided with a monitoring section 110 and a current control section 120. The monitoring section 110 is provided with an operational amplifier 111 and a capacitor 112. One input terminal of the operational amplifier 111 is connected to a power supply line Vdd of the semiconductor substrate through a capacitor 112 and the other input terminal is connected to a ground line Vss of the semiconductor substrate. This monitoring section 110 detects a variation in the potential of the power supply line Vdd through the capacitor 112. The operational amplifier 111 generates a monitor signal indicating the variation detected by the capacitor 112. The monitor signal generated is output to the current control section 120. The current control section 120 is provided with a current source 121 connected between the power supply line Vdd and ground line Vss. Furthermore, the current control section 120 amplifies a current of a current signal according to the monitor signal β times. The current source 121 can freely output the current amplified β times continuously from the power supply line Vdd. Therefore, the current I that flows through the capacitor 112 due to a voltage variation in the voltage of the power supply line Vdd is amplified β times by the current control section 120 and a current I×(1+β) flows out of the power supply line Vdd. Thus, the equivalent capacitance of the voltage stabilizer 100 shown in FIG. 3 is (1+β) times.

Figure 4:
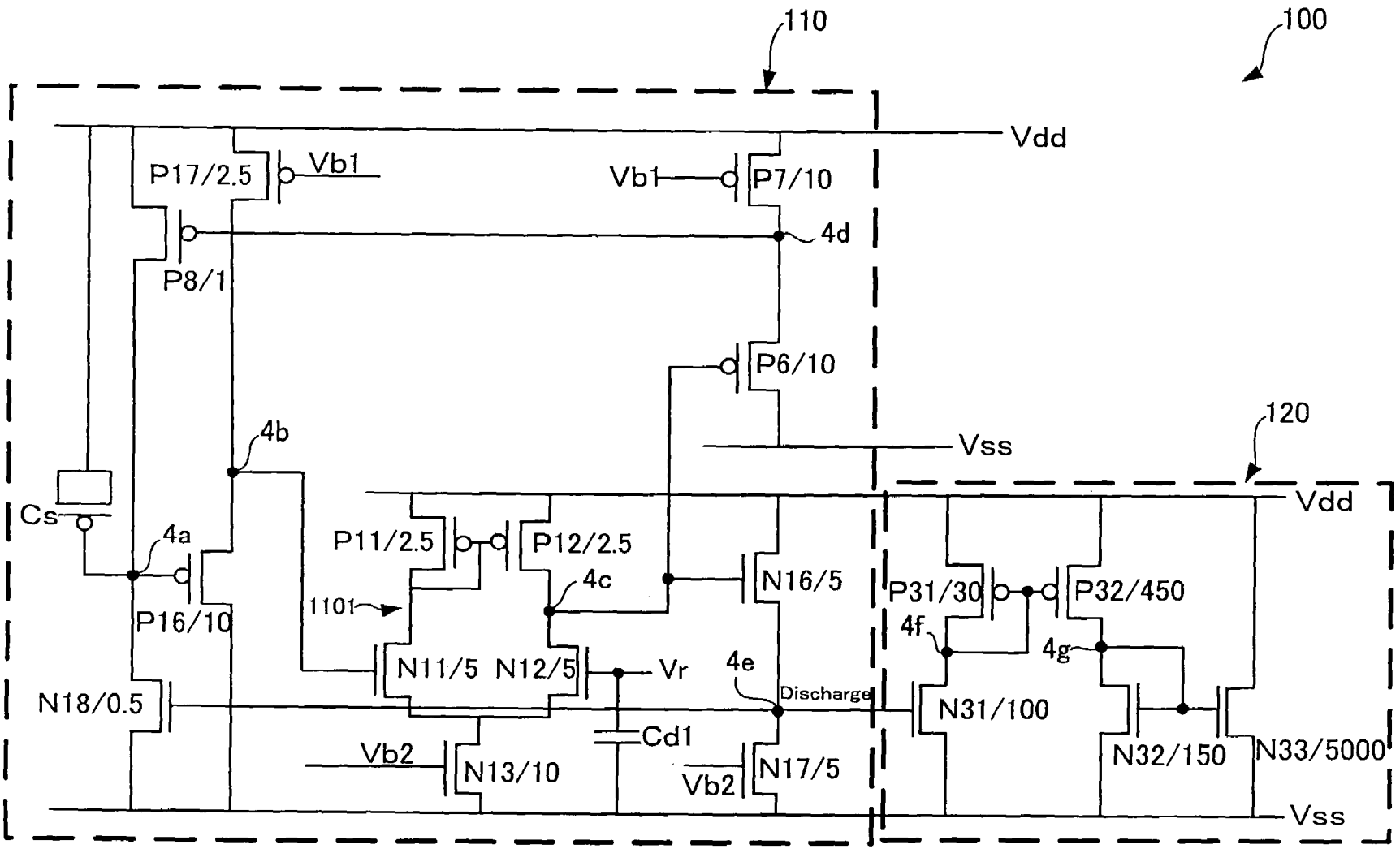
FIG. 4 is a circuit diagram of the voltage stabilizer according to the first embodiment.

FIG. 4 is a circuit diagram of the voltage stabilizer of the first embodiment.

The voltage stabilizer 100 shown in FIG. 3 is constructed by a combination of multiple capacitors and multiple MOS transistors, and in this FIG. 4, each MOS transistor is assigned an ID number as well as a relative transistor size. For example, "P8/1" assigned to the PMOS transistor at top left in the figure indicates that it is a P-type MOS transistor with an ID number 8 having a transistor size of 1. Furthermore, "N18/0.5" assigned to the NMOS transistor at bottom left in the figure indicates that it is an N-type MOS transistor with an ID number 18 having a transistor size of 0.5. Hereinafter, in the following circuit diagrams, suppose the same notation will be used for MOS transistors and ID numbers assigned in the figure will be used in the description.

Here, the circuit structure of the monitoring section 110 shown in FIG. 3 will be explained first.

As shown in FIG. 4, the monitoring section 110 shown in FIG. 3 includes four pairs of two MOS transistors connected in series between the power supply line Vdd and ground line Vss. These MOS transistor pairs are a pair of PMOS transistor 8 and NMOS transistor 18, a pair of PMOS transistor 17 and PMOS transistor 16, a pair of PMOS transistor 7 and PMOS transistor 6 and a pair of NMOS transistor 16 and NMOS transistor 17. A node 4*a* at which the PMOS transistor 8 and NMOS transistor 18 are connected is connected to a power supply line Vdd through a capacitor Cs and also connected to the gate of the PMOS transistor 16.

Furthermore, the monitoring section 110 shown in FIG. 4 also includes a differential amplifier 1101. The gate of the NMOS transistor 11 constituting the differential amplifier 1101 is connected to a node 4*b* at which the PMOS transistor 17 and PMOS transistor 16 are connected. One end of this NMOS transistor 11 constituting the differential amplifier 1101 is connected to one end of the NMOS transistors 12, 13. The other end of the NMOS transistor 13 is connected to the ground line Vss. Furthermore, the other ends of the NMOS transistors 11, 12 are connected to the power supply line Vdd via the PMOS transistors 11, 12, respectively. A node 4*c* at which the NMOS transistor 12 and PMOS transistor 12 are connected is connected to both gates of the PMOS transistor 6 and NMOS transistor 16. Furthermore, the other end (drain) of the NMOS transistor 11 is also connected to both gates of the two PMOS transistors 11, 12. Furthermore, a capacitor Cd1 is connected between the gate of the NMOS transistor 12 and ground line Vss. Furthermore, a reference voltage Vr which will be explained later is input to the gate of the NMOS transistor 12 and a low bias voltage Vb2 which is a voltage lower than the reference voltage Vr is input to the gate of the NMOS transistor 13.

Furthermore, the low bias voltage Vb2 is also input to the gate of the NMOS transistor 17 and a high bias voltage Vb1 which is a voltage higher than the above described reference voltage Vr is input to both gates of the PMOS transistor 17 and PMOS transistor 7.

Furthermore, the gate of the PMOS transistor 8 is connected to a node 4*d* at which the PMOS transistor 7 and PMOS transistor 6 are connected and the gate of the NMOS transistor 18 is connected to a node 4*e* at which the NMOS transistor 16 and NMOS transistor 17 are connected.

From the monitoring section 110 having such a circuit structure, the potential of the node 4*e* is output as a discharge signal.

Figure 5:
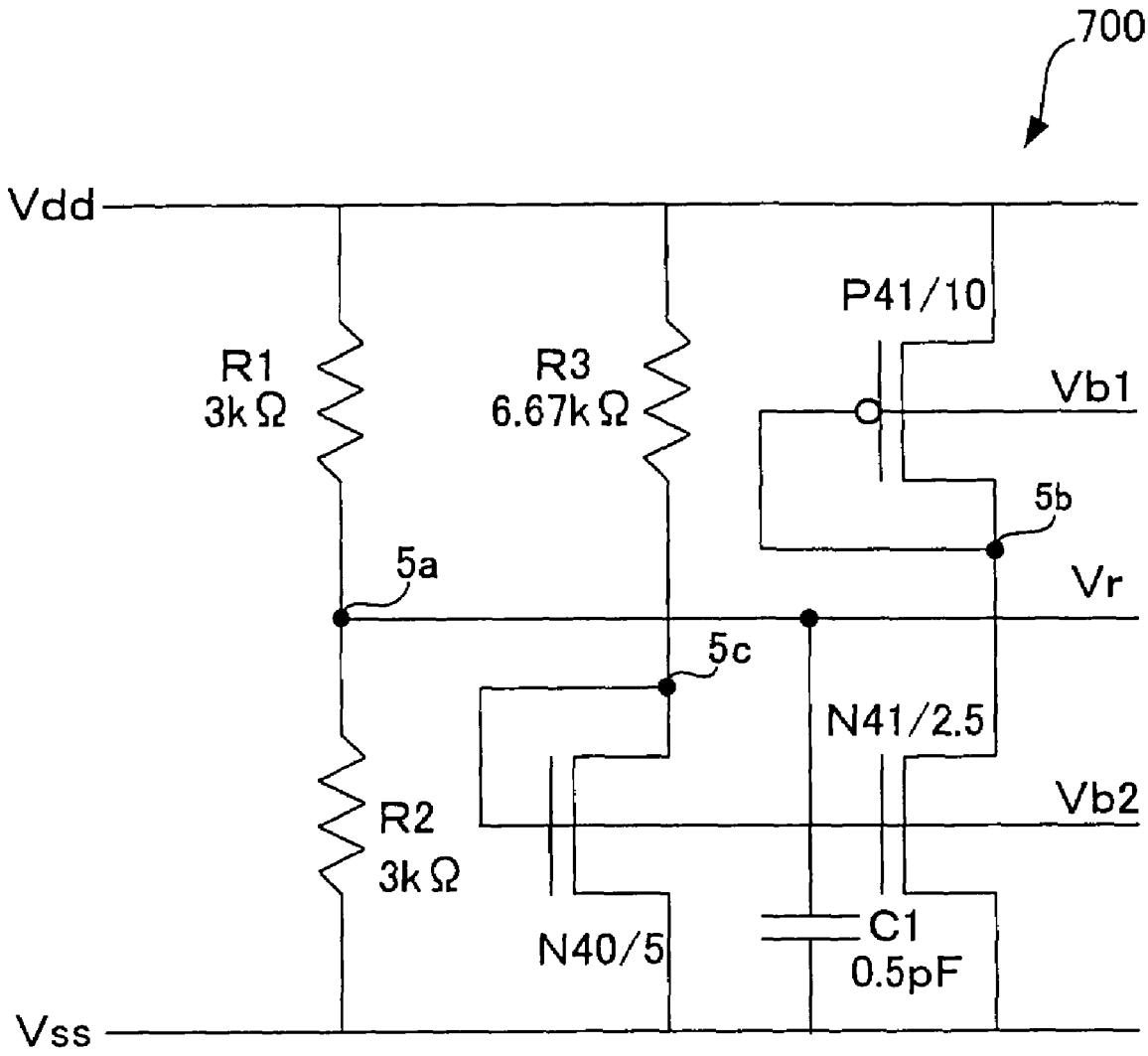
FIG. 5 is a circuit diagram of a predetermined voltage generation circuit incorporated in a semiconductor substrate.

The semiconductor substrate on which the voltage stabilizer 100 of the first embodiment is mounted incorporates a predetermined voltage generation circuit 700 shown in FIG. 5.

FIG. 5 is a circuit diagram of the predetermined voltage generation circuit incorporated in the semiconductor substrate.

The predetermined voltage generation circuit 700 shown in this FIG. 5 generates the reference voltage Vr, low bias voltage Vb2 and high bias voltage Vb1 by dividing the voltage between the power supply line Vdd and ground line Vss by means of resistors. That is, a resistor R1 (resistance value 3 kΩ) and resistor R2 (resistance value 3 kΩ) are connected in series between the power supply line Vdd and ground line Vss and the potential of a node 5*a* at which these resistors R1, R2 are connected is output as the reference voltage Vr. Therefore, the value of the reference voltage Vr is half the voltage value between the power supply line Vdd and ground line Vss. A capacitor C1 (capacitance 0.5 pF) to stabilize the reference voltage Vr is connected between the node 5*a* and ground line Vss. Furthermore, a resistor R3 (resistance value 6.67 kΩ) and an NMOS transistor 40 are connected in series between the power supply line Vdd and ground line Vss. Furthermore, a PMOS transistor 41 and an NMOS transistor 41 are also connected in series between the power supply line Vdd and ground line Vss. The gate of the PMOS transistor 41 is connected to a node 5*b* at which the PMOS transistor 41 and the NMOS transistor 41 are connected and the potential of the node 5*b* is output as the high bias voltage Vb1. Furthermore, both gates of the NMOS transistors 40, 41 are connected to a node 5*c* at which the resistor R3 and NMOS transistor 40 are connected and the potential of this node 5*c* is output as the low bias voltage Vb2. These voltages Vr, Vb2 and Vb1 have a magnitude relationship of high bias voltage Vb1>reference voltage Vr>low bias voltage Vb2.

Furthermore, both gates of the NMOS transistors 40, 41 are connected to a node 5*c* at which the resistor R3 and NMOS transistor 40 are connected and the potential of this node 5*c* is output as the low bias voltage Vb2. These voltages Vr, Vb2 and Vb1 have a magnitude relationship of high bias voltage Vb>reference voltage Vr>low bias voltage Vb2.

Next, the circuit operation of the monitoring section 110 will be explained using FIG. 4 again.

When the potential of the power supply line Vdd changes, the capacitor Cs detects the variation and the voltage indicating the variation detected by the capacitor Cs is applied to the node 4*a*. When the potential of the node 4*a* changes toward the high potential side, the ON-resistance of the PMOS transistor 16 increases and the current that flows through the PMOS transistor 16 decreases. Then, the potential of the node 4*b* increases. In response to the increase in the potential of the node 4*b*, the potential of the node 4*c* of the differential amplifier 1101 also increases. When the potential of the node 4*c* increases, the ON-resistance of the PMOS transistor 6 increases and the ON-resistance of the NMOS transistor 16 decreases. As a result, the current flowing through the PMOS transistor 6 decreases and the potential of the node 4*d* thereby increases and the ON-resistance of the PMOS transistor 8 increases. Furthermore, the current flowing through the NMOS transistor 16 increases and the potential of the node 4*e* also increases, which causes the ON-resistance of the NMOS transistor 18 to decrease. The increased potential of the node 4*e* is output as a discharge signal. This discharge signal corresponds to the monitor signal generated by the monitoring section 110 shown in FIG. 3.

On the contrary, when the potential of the node 4*a* changes toward the low potential side, the circuit operation of this monitoring section 110 becomes opposite to the operation when the potential of the node 4*a* changes toward the high potential side and the potential of the node 4*e* decreases.

Next, the circuit structure of the current control section 120 shown in FIG. 3 will be explained.

As shown in FIG. 4, the current control section 120 shown in FIG. 3 has two pairs of PMOS transistor and NMOS transistor connected in series between the power supply line Vdd and ground line Vss. These pairs of MOS transistors are a pair of PMOS transistor 31 and NMOS transistor 31 and a pair of PMOS transistor 32 and NMOS transistor 32. Furthermore, there is also an NMOS transistor 33 connected between the power supply line Vdd and ground line Vss. The discharge signal is input to the gate of the NMOS transistor 31. A node 4*f* at which the PMOS transistor 31 and NMOS transistor 31 are connected is commonly connected to the gates of the two PMOS transistors 31, 32 and these PMOS transistors 31, 32 constitute a current mirror circuit. The transistor size of the PMOS transistor 32 which is one component of this current mirror circuit is 15 times the transistor size of the PMOS transistor 31, the other component. Furthermore, a node 4*g* at which the PMOS transistor 32 and NMOS transistor 32 are connected is commonly connected to the gates of the two NMOS transistors 32, 33 and these NMOS transistors 32, 33 also constitute a current mirror circuit. The transistor size of the NMOS transistor 33 which is one component of this current mirror circuit is more than 33 times the transistor size of the NMOS transistor 32, the other component.

Next, the circuit operation of this current control section 120 will be explained.

The current control section 120 shown in FIG. 4 amplifies a current of a current signal corresponding to the input discharge signal in two stages. When the potential of the node 4*e* increases, the discharge signal indicating the increased potential is input to the gate of the NMOS transistor 31 and the ON-resistance of the NMOS transistor 31 decreases. Then, the potential of the node 4*f* changes toward the low potential side and both ON-resistances of the two PMOS transistors 31, 32 decrease. Due to the decrease of this ON-resistance, the potential of the node 4*g* increases and both ON-resistances of the two NMOS transistors 32, 33 decrease. As a result, the current flowing through the path in which the PMOS transistor 31 and NMOS transistor 31 are connected in series becomes a current signal corresponding to the discharge signal input to the gate of the NMOS transistor 31. Here, since the PMOS transistor 32 has a transistor size by far greater than that of the PMOS transistor 31, a greater amount of current than that of the current of the current signal flows from the power supply line Vdd into the path in which the PMOS transistor 32 and NMOS transistor 32 are connected in series. Furthermore, due to the difference in transistor size between the two NMOS transistors 32, 33, a greater amount of current than the current flowing through the path in which the PMOS transistor 32 and NMOS transistor 32 are connected in series flows from the power supply line Vdd to the NMOS transistor 33.

On the contrary, when the potential of the node 4*e* decreases, the ON-resistance of the NMOS transistor 31 increases and finally the amount of current flowing through the NMOS transistor 33 decreases.

Here, a power supply voltage is applied to the power supply line Vdd shown in FIG. 4 from a power supply (not shown) through a power supply path connecting the power supply and semiconductor substrate. The voltage stabilizer 100 shown in FIG. 3 is designed so that the amount of current flowing through the NMOS transistor 33 becomes substantially 0 when the voltage of the power supply line Vdd falls below the power supply voltage and in such a case, the passage of the current from the power supply line Vdd is stopped.

According to such a voltage stabilizer 100 of the first embodiment, even if the voltage of the power supply path connecting the power supply and semiconductor substrate increases, the first current control section 120 shown in FIG. 3 passes a current from the power supply line Vdd continuously, and can thereby stabilize the voltage of the power supply path. Moreover, the first current control section 120 outputs an amplified current of a current signal. The magnitude of amplification of a current can be much greater than that of a voltage, a few thousand times, for example. Thus, the voltage stabilizer 100 according to the first embodiment can increase an equivalent capacitance while the size of the voltage stabilizer is kept as is. As a result, the voltage stabilizer 100 can reduce the mounting area on the semiconductor substrate.

Next, a current stabilizer according to a second embodiment of the present invention will be explained.

Figure 6:
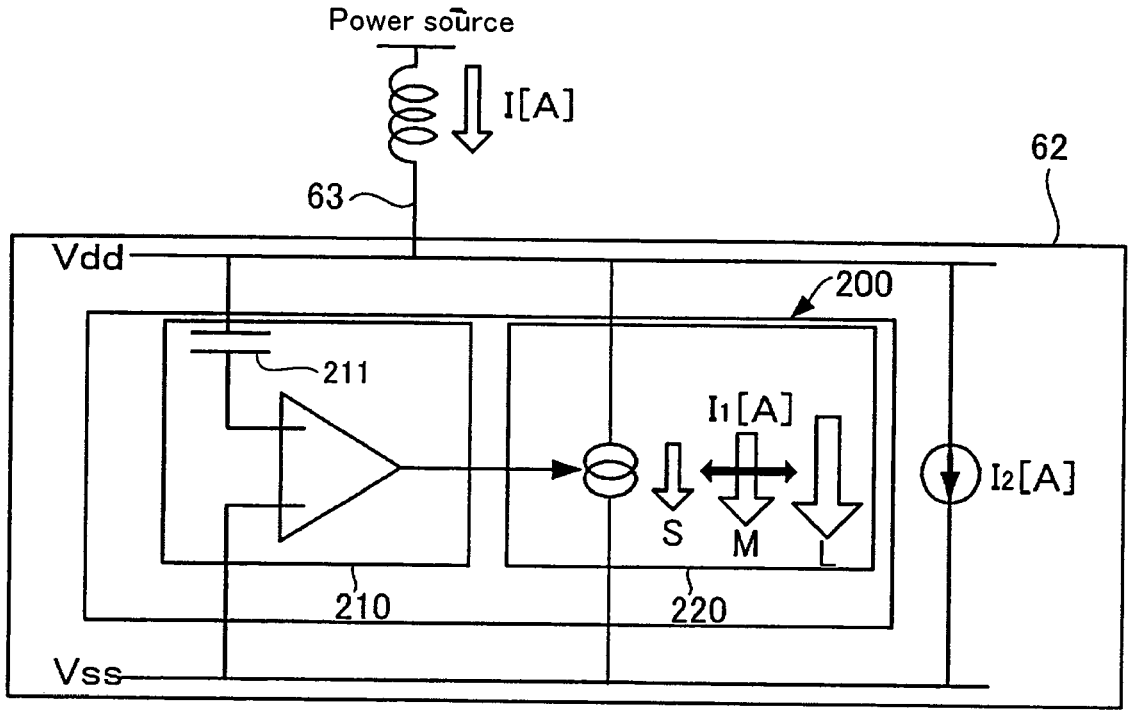
FIG. 6 conceptually illustrates a voltage stabilizer according to a second embodiment.

FIG. 6 conceptually illustrates the voltage stabilizer according to the second embodiment.

FIG. 6 illustrates a power supply path 63 which connects a power supply and a semiconductor substrate 62. A current I which flows through this power supply path 63 flows into a power supply line Vdd provided on the semiconductor substrate 62 and flows through a load circuit (not shown) incorporated in the semiconductor substrate 62 (see 2 in the figure).

Just as the voltage stabilizer 100 of the first embodiment shown in FIG. 3, the voltage stabilizer 200 shown in FIG. 6 is also provided with a monitoring section 210 and current control section 220. The monitoring section 210 shown in FIG. 6 has the same structure and function as those of the monitoring section 110 shown in FIG. 3, and the current control section 220 shown in FIG. 6 will be explained here. This current control section 220 passes a current according to a monitor signal generated by the monitoring section 210 from the power supply line Vdd continuously. That is, the current control section 220 keeps the current $I_1$ passed from the power supply line Vdd to a predetermined reference current (see arrow M) when the voltage of the power supply line Vdd is stable at the power supply voltage or changes the current $I_1$ to a higher current (see arrow L) than the predetermined reference current based on the monitor signal input from the monitoring section 210 when the potential of the power supply line Vdd changes toward the high potential side or on the contrary changes the current $I_1$ to a lower current (see arrow S) than the predetermined reference current when the potential of the power supply line Vdd changes toward the low potential side based on the monitor signal.

Here, using FIG. 7 as well as FIG. 6, the operation of this voltage stabilizer 200 will be explained.

Figure 7:
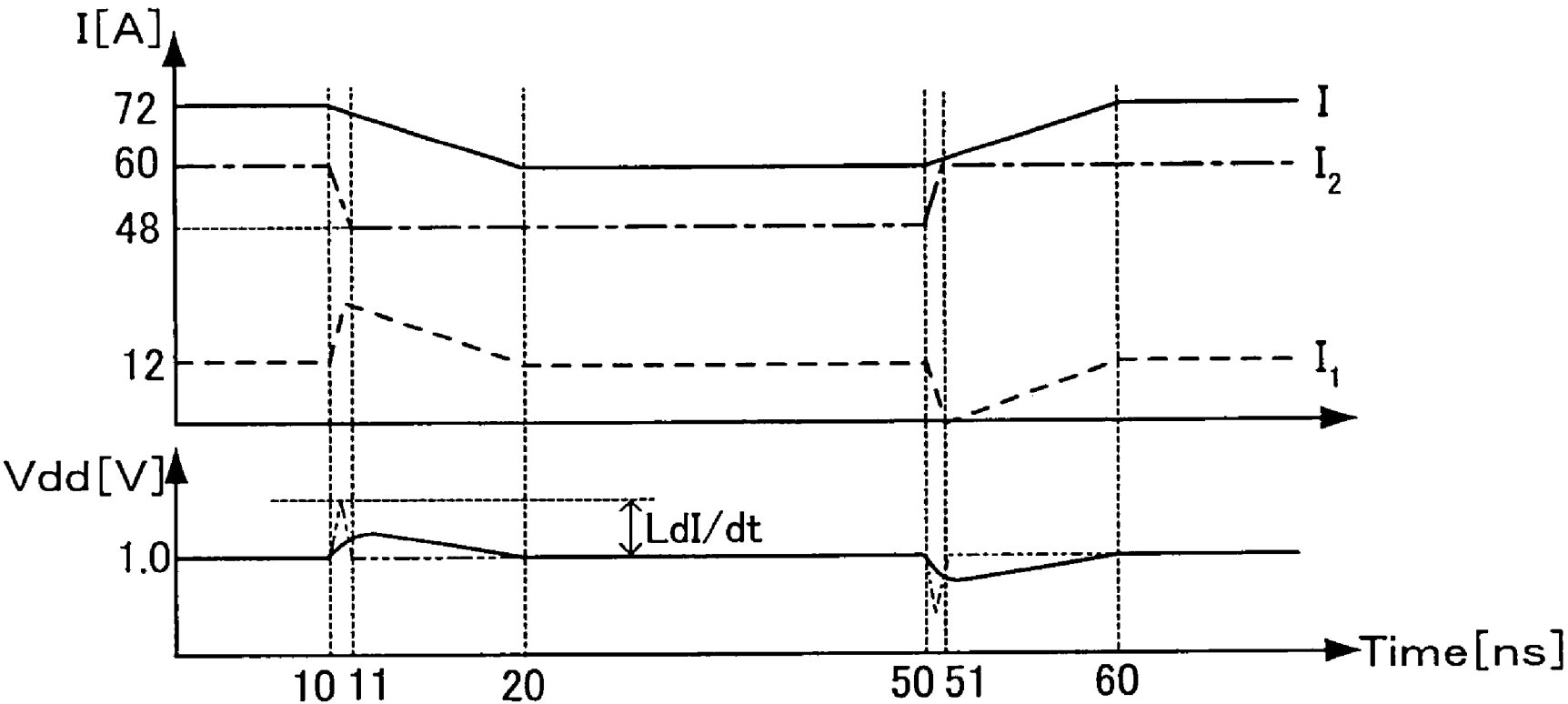
FIG. 7 is a timing chart showing a current variation in the power supply path shown in FIG. 6 and a voltage variation of the power supply line.

FIG. 7 is a timing chart showing a current variation in the power supply path and voltage variation in the power supply line shown in FIG. 6.

A graph showing the current variation in the power supply path 63 shown in FIG. 6 is shown on the upper row in FIG. 7 and a graph showing the voltage variation in the power supply line Vdd shown in FIG. 6 is shown below the above described graph. The horizontal axes of these graphs show a time (nanosecond) and the two graphs are arranged so that the same time is indicated on the same scale. The vertical axis in the upper graph shows a current value (A) and the vertical axis in the lower graph shows a voltage value (V). The upper graph in FIG. 7 shows a current variation of the power supply path 63 shown in FIG. 6 with a solid line and shows a variation in the amount of current of the current $I_1$ passed from the power supply line Vdd by the current control section 220 with a dotted line, further shows a current variation of a current $I_2$ flowing through the load circuit incorporated in the semiconductor substrate 62 with a single-dot dashed line. Furthermore, the lower graph in FIG. 7 shows a voltage variation in the power supply line Vdd shown in FIG. 6 with a solid line and also shows a voltage variation in the power supply line Vdd of a semiconductor substrate in which the voltage stabilizer 200 shown in FIG. 6 is not incorporated with a two-dot dashed line for comparison.

In the explanation here, suppose the power supply voltage is 1.0 V and a current of 60 A is initially flowing through the load circuit of the semiconductor substrate 62. When the voltage of the power supply line Vdd is stable at the power supply voltage of 1.0 V, the current control section 220 is outputting a current of 12 A from the power supply line Vdd as shown with the dotted line. This current of 12 A corresponds to the reference current indicated by the arrow M in FIG. 6.

Here, when the current $I_2$ flowing into the load circuit is reduced from 60 A to 48 A, the potential of the power supply line Vdd increases. The potential of the power supply line Vdd of the semiconductor substrate without the voltage stabilizer 200 shown in FIG. 6 drastically increases from the power supply potential as indicated with the two-dot dashed line. That is, due to inductance L in the power supply path connecting the power supply and semiconductor substrate, a potential increase corresponding to (L dI/dt) occurs on the power supply line Vdd. However, in the case of the semiconductor substrate 62 on which the voltage stabilizer 200 shown in FIG. 6 is mounted, the capacitor 211 provided for the monitoring section 210 detects the potential increase in the power supply line Vdd and the monitoring section 210 outputs a monitor signal indicating the amount of increase, and the current control section 220 thereby drastically increases the amount of current of the current $I_1$ passed from the power supply line Vdd as shown with the dotted line. Since such a large amount of current is output from the power supply line Vdd, the current variation of the power supply path 63 is limited to a small decrease as shown with the solid line on the upper row and generation of a counter-electromotive force is suppressed to a minimum value. This also suppresses a drastic potential increase of the power supply line Vdd and the potential variation of the power supply line Vdd is limited to a small increase as shown with the solid line below. The monitoring section 210 detects this small potential increase of the power supply line Vdd and outputs a monitor signal. The current control section 220 generates a current signal corresponding to this monitor signal and passes the current $I_1$ which is an amplified current of the generated current signal from the power supply line Vdd. The amount of the current $I_1$ passed from the power supply line Vdd decreases gradually and the amount of the current I flowing through the power supply path 63 also decreases gradually and the potential of the power supply line Vdd also decreases gradually. As a result, the current $I_1$ passed by the current control section 220 from the power supply line Vdd returns to the reference current of 12 A and the potential of the power supply line Vdd also returns to the power supply potential of 1.0 V. Furthermore, the current variation of the power supply path 63 also stops together and the amount of the current I passed into the power supply path 63 is stabilized. The current $I_2$ of 48 A continues to flow through the load circuit.

Then, when the current $I_2$ passed into the load circuit returns from 48 A to 60 A, contrary to the above described explanation, the current $I_1$ passed by the current control section 220 from the power supply line Vdd decreases drastically from the reference current of 12 A. Thus, the current variation in the power supply path 63 is limited to a small increase and generation of a counter-electromotive force is suppressed to a minimum value. Thus, the potential variation in the power supply line Vdd is limited to a small decrease. Thereafter, the current $I_1$ passed from the power supply line Vdd increases gradually up to 12 A, which causes the amount of current flowing through the power supply path 63 to also increase gradually and the potential of the power supply line Vdd to also increase gradually up to 1.0 V. As a result, the current variation in the power supply path 63 also stops and the amount of current of the power supply path 63 is stabilized.

Thus, when the voltage of the power supply line Vdd exceeds the power supply voltage, the voltage stabilizer 200 shown in FIG. 6 changes the current $I_1$ passed from the power supply line Vdd by an amount less than that of the reference current to thereby supply a current to the power supply line Vdd in a pseudo-form, and can thereby stabilize the voltage of the power supply line Vdd even when the voltage of the power supply line Vdd increases or decreases, and suppress the current variation of the power supply path 63 consequently.

Next, a current stabilizer of a third embodiment of the present invention will be explained.

Figure 8:
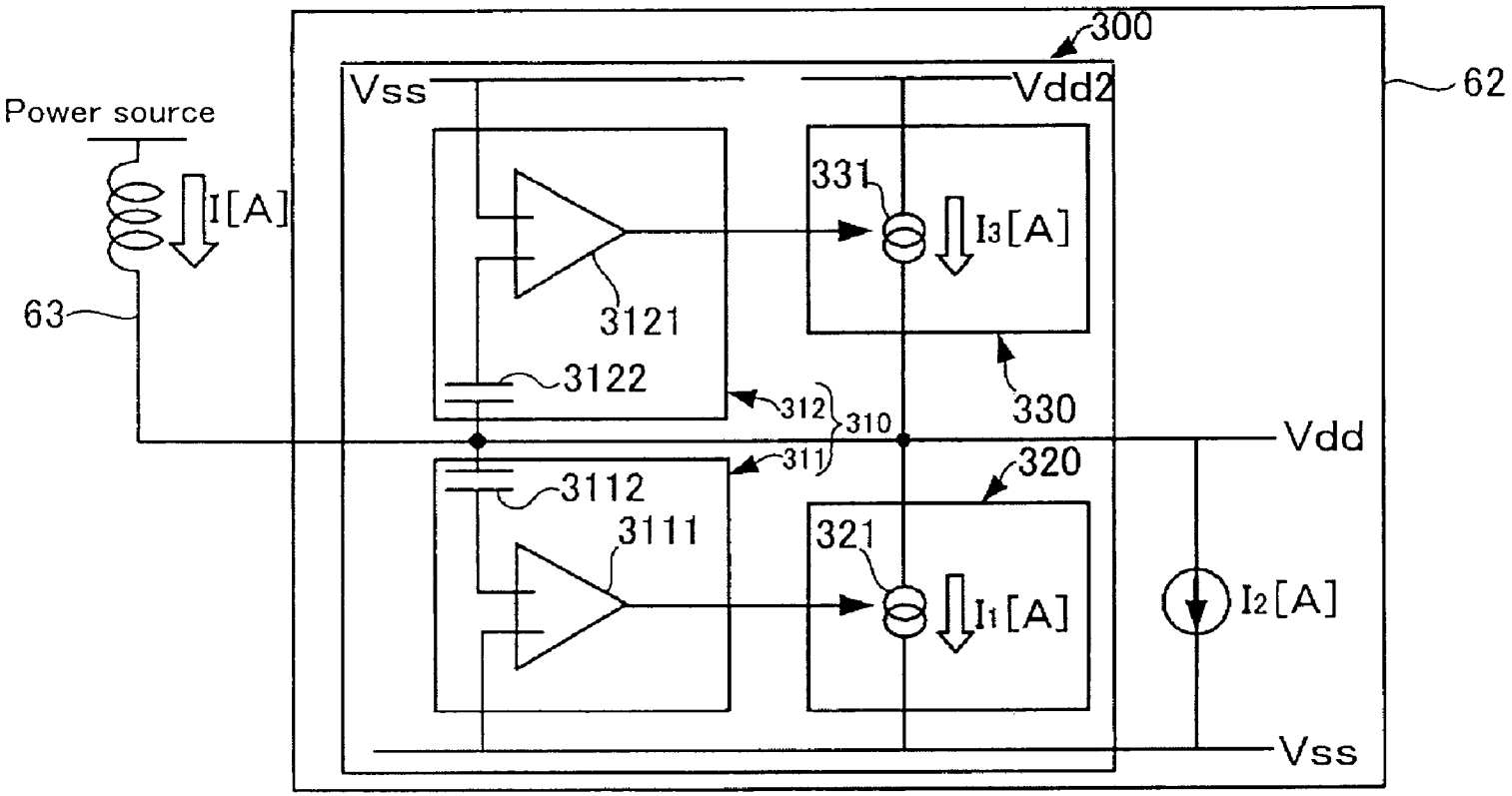
FIG. 8 schematically illustrates a voltage stabilizer according to a third embodiment.

FIG. 8 conceptually illustrates the voltage stabilizer according to the second embodiment shown in FIG. 6.

The voltage stabilizer 300 shown in FIG. 8 is a circuit incorporated in the semiconductor substrate 62 as with the voltage stabilizers 100, 200 explained so far. The voltage stabilizer 300 shown in FIG. 8 is provided with a monitoring section 310, a first current control section 320, a second current control section 330 and also a high potential line Vdd2 having a predetermined high potential higher than the power supply line Vdd. The monitoring section 310 has a first monitoring section 311 that generates a first monitor signal indicating a variation toward the high potential side when the potential of the power supply line Vdd changes toward the high potential side. Furthermore, the monitoring section 310 also has a second monitoring section 312 that generates a second monitor signal indicating a variation toward the low potential side when the potential of the power supply line Vdd changes toward the low potential side. Both monitoring sections 311, 312 are made up of operational amplifiers 3111, 3121 and capacitors 3112, 3122 and such structures are the same as the structure of the monitoring section 110 provided for the voltage stabilizer 100 shown in FIG. 3. Here, detailed explanations of the monitoring section 310 shown in FIG. 8 will be omitted. The first monitoring section 311 outputs the first monitor signal generated to the first current control section 320. The first current control section 320 is the same as the current control section 120 provided for the voltage stabilizer 100 shown in FIG. 3 in aspects of the structure and function, provided with a current source 321, generates a current signal corresponding to the first monitor signal input and passes a current $I_1$ which is an amplified current of the generated current signal from the power supply line Vdd through the current source 321. Furthermore, the second monitoring section 312 outputs the second monitor signal generated to the second current control section 330. The second current control section 330 has a current source 331 connected between the high potential line Vdd2 and power supply line Vdd. When the second current control section 330 receives a second monitor signal, it generates a current signal corresponding to the second monitor signal and passes a current $I_3$ which is an amplified current of the generated current signal from the high potential line Vdd2 into the power supply line Vdd through the current source 331.

This FIG. 8 illustrates a power supply path 63 that supplies power from a power supply to the power supply line Vdd of the semiconductor substrate 62 in which a load circuit (not shown) is incorporated. A current I flows through the power supply path 63 and a current $I_2$ flows through the load circuit (not shown).

Here, the operation of this voltage stabilizer 300 will be explained using FIG. 9 as well as FIG. 8.

Figure 9:
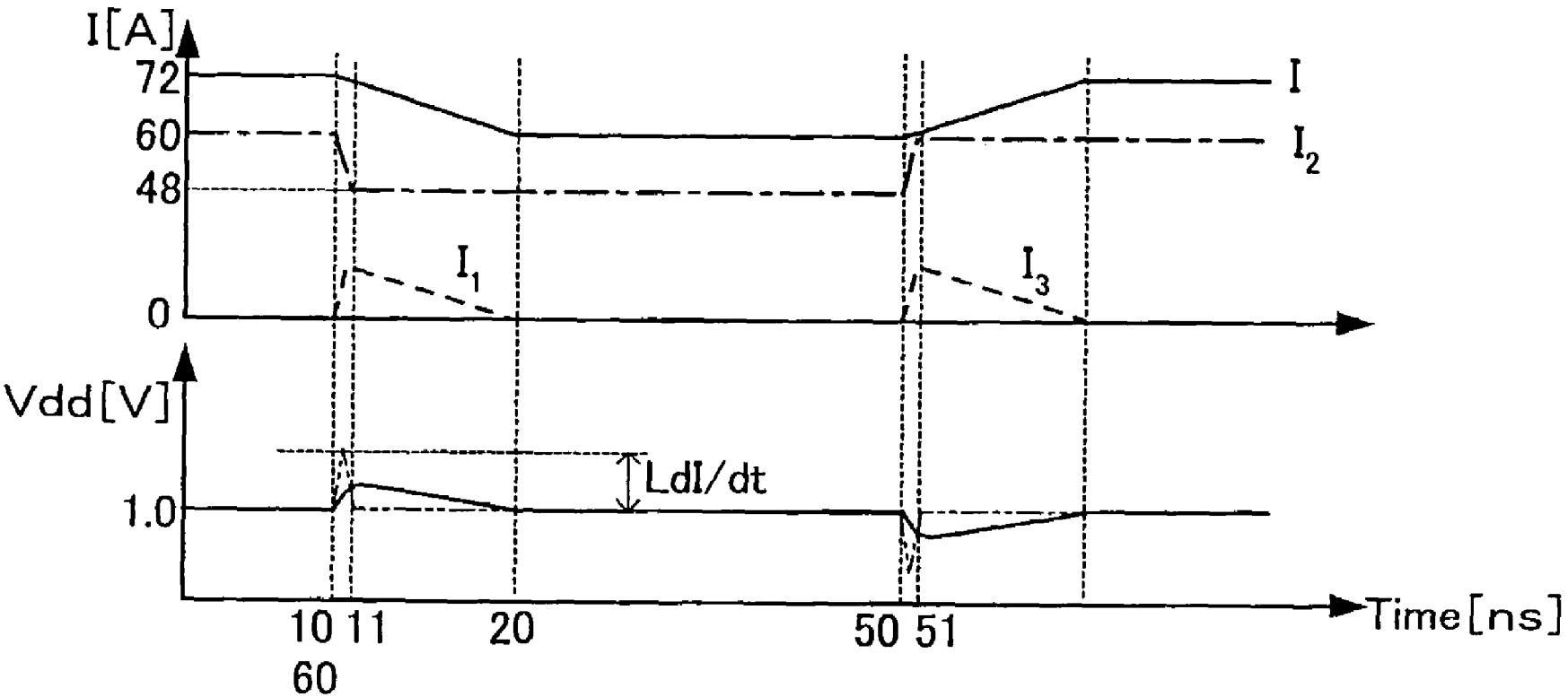
FIG. 9 is timing chart showing a current variation in the power supply path shown in FIG. 8 and a voltage variation of the power supply line.

FIG. 9 is timing chart showing a current variation in the power supply path and voltage variation in the power supply line shown in FIG. 8.

This FIG. 9 shows two graphs up and down similar to the timing chart in FIG. 7 used in the explanation of the voltage stabilizer 200 according to the second embodiment. The graph shown on the upper row in FIG. 9 is a graph indicating a current variation of the power supply path 63 shown in FIG. 8 and the graph shown on the lower row in FIG. 9 is a graph indicating a voltage variation in the power supply line Vdd shown in FIG. 8. The upper graph in FIG. 9 shows both a variation in the amount of current $I_1$ passed by the first current control section 320 from the power supply line Vdd and a variation in the amount of current $I_3$ passed by the second current control section 330 from the high potential line Vdd2 into the power supply line Vdd with dotted lines.

When the voltage of the power supply line Vdd is stable at a power supply voltage of 1.0 V, the first current control section 320 shown in FIG. 8 stops the passage of the current $I_1$ from the power supply line Vdd and the second current control section 330 also stops the passage of the current $I_3$ into the power supply line Vdd.

Here, when the amount of current $I_2$ flowing into the load circuit decreases from 60 A to 48 A, the voltage of the power supply line Vdd increases from the power supply voltage. The first monitoring section 311 detects the variation in the potential of this power supply line Vdd toward the high potential side and generates a first monitor signal. When the first monitor signal generated is input to the first current control section 320, the first current control section 320 which has been stopping the passage of the current $I_1$ from the power supply line Vdd starts to pass the current $I_1$ instantaneously. As a result, the current variation in the power supply path 63 is limited to a small decrease and generation of a counter-electromotive force is suppressed to a minimum value and the potential variation of the power supply line Vdd does not produce a drastic potential increase corresponding to (L dI/dt) shown with the two-dot dashed line but is limited to a small increase as shown with the solid line. Thereafter, the amount of current $I_1$ passed from the power supply line Vdd decreases gradually and the amount of current I flowing through the power supply path 63 also decreases gradually and the potential of the power supply line Vdd also decreases gradually down to the power supply potential of 1.0 V. As a result, the current variation of the power supply path 63 also stops and the amount of current I flowing through the power supply path 63 is stabilized. In the mean time, the passage of the current $I_3$ by the second current control section 330 from the high potential line Vdd2 to the power supply line Vdd is stopped. A current $I_2$ of 48 A continues to flow through the load circuit.

Then, when the amount of current $I_2$ flowing through the load circuit returns from 48 A to 60 A, the voltage of the power supply line Vdd decreases from the power supply voltage. The second monitoring section 312 detects the variation in the potential of the power supply line Vdd toward the low potential side and generates a second monitor signal. When the second monitor signal generated is input to the second current control section 330, the second current control section 330 which has been stopping the passage of the current $I_3$ from the high potential line Vdd2 so far starts to pass the current $I_3$ instantaneously. As a result, the current variation in the power supply path 63 is limited to a small decrease and generation of a counter electromotive force is suppressed to a minimum value and the potential variation of the power supply line Vdd is limited to a small decrease. Thereafter, the amount of current $I_3$ passed from the power supply line Vdd2 decreases gradually and the amount of current I passed into the power supply path 63 also increases gradually and the potential of the power supply line Vdd also increases gradually up to the power supply potential of 1.0 V. As a result, the current variation of the power supply path 63 also stops and the amount of current I flowing through the power supply path 63 is stabilized. In the mean time, the passage of the current $I_1$ by the first current control section 320 from the power supply line Vdd is stopped.

Thus, when the voltage of the power supply line Vdd changes, the voltage stabilizer 300 shown in FIG. 8 passes the current from the power supply line Vdd or passes the current into the power supply line Vdd according to the variation and stops the passage of current from/into the power supply line Vdd otherwise, and can thereby suppress the current variation in the power supply path 63 with low power.

Figure 10:
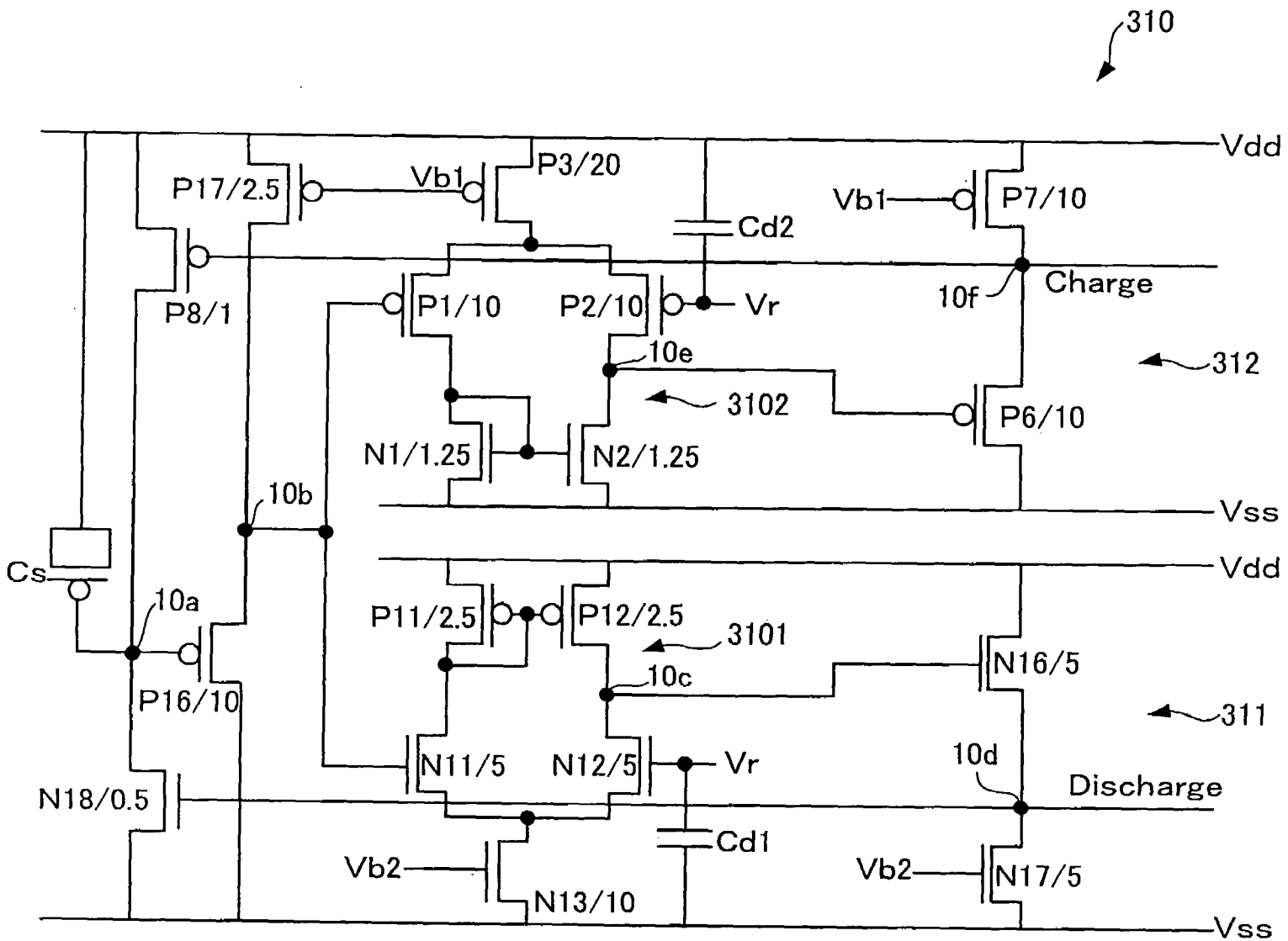
FIG. 10 is a circuit diagram of a monitoring section provided for a voltage stabilizer according to the third embodiment.

FIG. 10 is a circuit diagram of a monitoring section provided for the voltage stabilizer according to the third embodiment.

The monitoring section 310 shown in FIG. 10 has a structure including two circuits of the monitoring section 110 provided for the voltage stabilizer 100 according to the first embodiment shown in FIG. 4 and the circuit structure as well as the circuit operation will be explained briefly here. The monitoring section 310 shown in this FIG. 10 has two differential amplifiers 3101, 3102. One differential amplifier 3101 is provided for the first monitoring section 311 and the other differential amplifier 3102 is provided for the second monitoring section 312. Furthermore, the semiconductor substrate 62 shown in FIG. 8 also incorporates the predetermined voltage generation circuit 700 shown in FIG. 5 and described above and all the reference voltage Vr, high bias voltage Vb1 and low bias voltage Vb2 input to the gates of several MOS transistors shown in FIG. 10 are generated by the predetermined voltage generation circuit 700 shown in FIG. 5.

When the potential of the power supply line Vdd changes, the voltage indicating the voltage variation in the power supply line Vdd detected by the capacitor Cs is applied to a node 10*a*. When the potential of the node 10*a* changes toward the high potential side, the ON-resistance of the PMOS transistor 16 increases and the potential of a node 10*b* increases. In response to the increase in the potential of the node 10*b*, the potential of a node 10*c* of the differential amplifier 3101 provided for the first monitoring section 311 also increases and the current passed through the NMOS transistor 16 increases. As a result, the potential of a node 10*d* also increases. The potential of the node 10*d* is output as a discharge signal. On the other hand, in response to the increase of the potential of the node 10*b*, the potential of a node 10*e* of the differential amplifier 3102 provided for the second monitoring section 312 also increases and the current passed through the PMOS transistor 6 decreases. As a result, the potential of a node 10*f* also increases. The potential of the node 10*f* is output as a charge signal.

On the contrary, when the potential of the node 10*a* changes toward the low potential side, the circuit operation of this monitoring section 310 becomes opposite to the operation when the potential of the node 10*a* changes toward the high potential side and the potential of the node 10*d* as well as the potential of the node 10*f* decreases.

Figure 11:
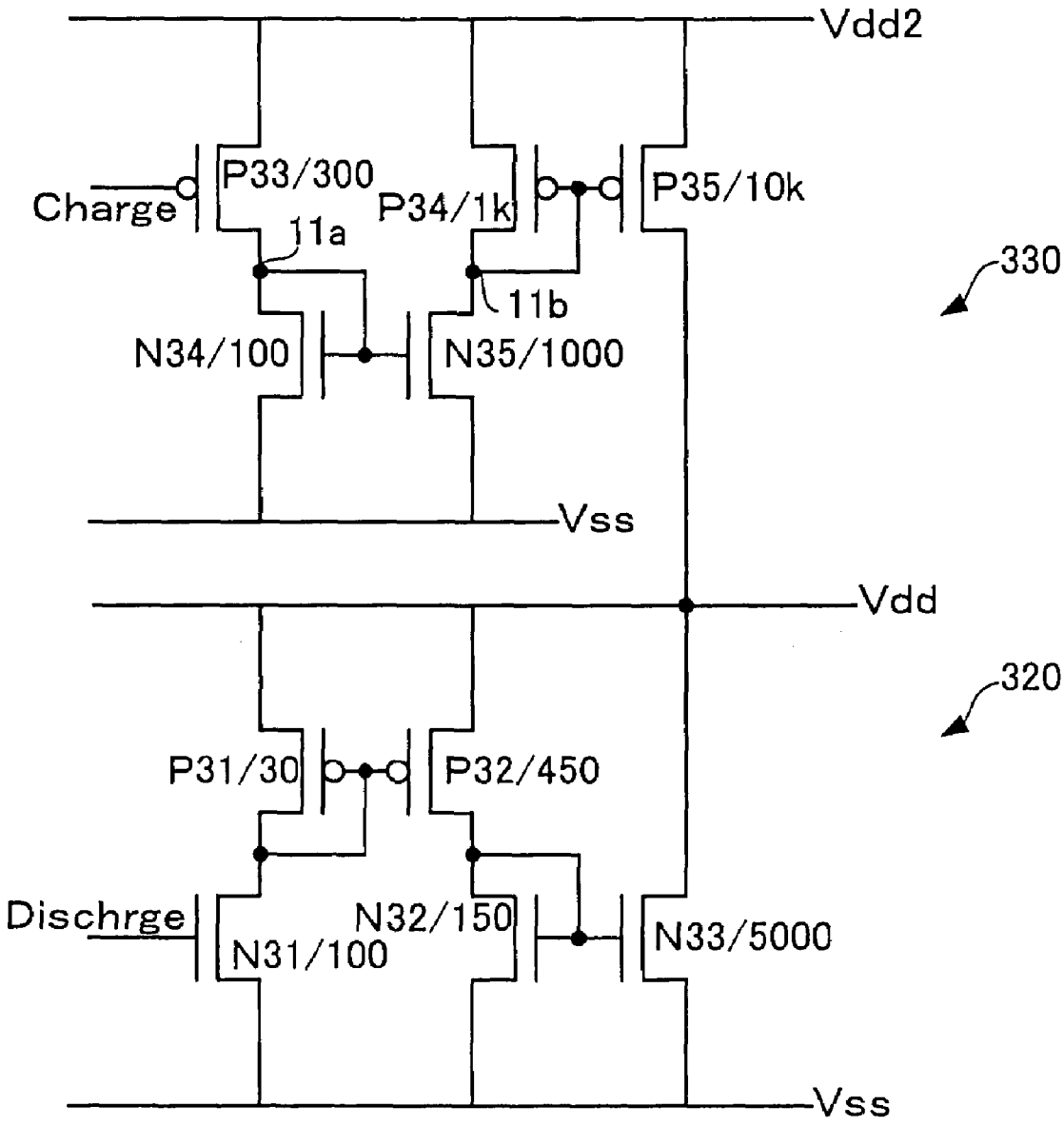
FIG. 11 is a circuit diagram of a first current control section and a second current control section provided for the voltage stabilizer according to the third embodiment.

FIG. 11 is a circuit diagram of a first current control section and a second current control section provided for the voltage stabilizer according to the third embodiment.

The circuit structure of the first current control section 320 shown in FIG. 11 has the same circuit structure as that of the current control section 120 provided for the voltage stabilizer 100 according to the first embodiment shown in FIG. 4, and the circuit structure of the second current control section 330 will be explained here first.

The second current control section 330 shown in FIG. 11 has two pairs of PMOS transistor and NMOS transistor connected in series between the high potential line Vdd2 and ground line Vss. These pairs of MOS transistors are a pair of PMOS transistor 33 and NMOS transistor 34, and a pair of PMOS transistor 34 and NMOS transistor 35. There is also a PMOS transistor 35 connected between the high potential line Vdd2 and power supply line Vdd. Such a second current control section 330 includes two current mirror circuits; a current mirror circuit made up of the NMOS transistors 34, 35 and a current mirror circuit made up of the PMOS transistors 34, 35. The transistor size of the NMOS transistor 35 is 10 times the transistor size of the NMOS transistor 34 and the transistor size of the PMOS transistor 35 is also 10 times the transistor size of the PMOS transistor 34.

Next, the circuit operations of the first current control section 320 and the second current control section 330 will be explained.

A discharge signal is input to the gate of the NMOS transistor 31 making up the first current control section 320 and a charge signal is input to the gate of the PMOS transistor 33 making up the second current control section 330. Here, as described above, if the potential of the node 10*a* shown in FIG. 10 increases, both the potential of the node 10*d* and the potential of the node 10*f* increase and on the contrary when the potential of the node 10*a* decreases, the potential of the node 10*d* together with the potential of the node 10*f* decreases. When the potential of the node 10*d* increases, the first current control section 320 shown in FIG. 11 generates a current signal corresponding to the discharge signal indicating the increased potential of the node 10*d*. The current of the current signal generated is amplified in two stages and the current amplified in two stages is passed from the power supply line Vdd. Furthermore, the second current control section 330 shown in FIG. 11 generates a current signal corresponding to the charge signal input and amplifies the current of the current signal generated in two stages as with the first current control section 320. When a charge signal indicating the increased potential of the node 10*f* is input to the gate of the PMOS transistor 33, the ON-resistance of the PMOS transistor 33 increases. Then, the potential of a node 11*a* at which the PMOS transistor 33 and NMOS transistor 34 are connected changes toward the low potential side and ON-resistances of the two NMOS transistors 34, 35 also increase. Due to this increase in the ON-resistance, the potential of a node 11*b* at which the PMOS transistor 34 and NMOS transistor 35 are connected increases and both ON-resistances of the two PMOS transistors 34, 35 increase. As a result, it is more difficult for the current flowing from the high potential line Vdd2 into the power supply line Vdd to flow through the path in which the PMOS transistor 34 and NMOS transistor 35 are connected in series as well as through the PMOS transistor 35.

On the contrary, when a discharge signal indicating a potential drop at the node 10*d* is input, it is more difficult for the current flowing from the power supply line Vdd to flow into the NMOS transistor 33 making up the first current control section 320. Furthermore, the second current control section 330 amplifies a current based on a charge signal indicating a potential drop at the node 10*f* in two stages and the current amplified in two stages flows from the high potential line Vdd2 into the power supply line Vdd.

Therefore, the discharge signal indicating the increased potential of the node 10*d* corresponds to the first monitor signal generated by the first monitoring section 311 shown in FIG. 8 and the charge signal indicating the reduced potential of the node 10*f* corresponds to the second monitor signal generated by the second monitoring section 312.

Next, the current stabilizer according to a fourth embodiment of the present invention will be explained.

Figure 12:
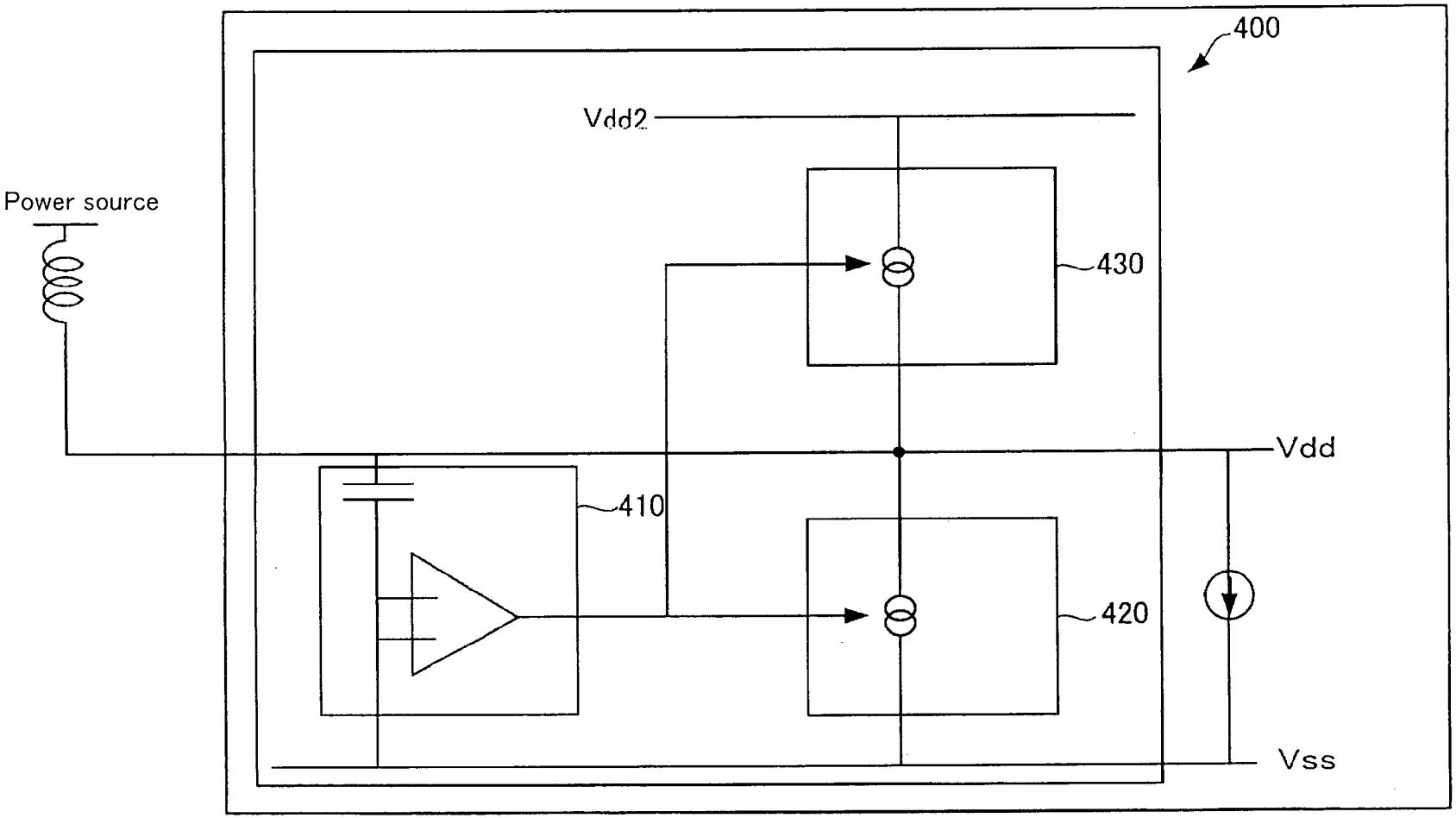
FIG. 12 schematically illustrates a voltage stabilizer according to a fourth embodiment.

FIG. 12 schematically illustrates the voltage stabilizer according to the fourth embodiment.

The voltage stabilizer 400 according to the fourth embodiment shown in FIG. 12 has the same structure as that of the voltage stabilizer 300 according to the third embodiment shown in FIG. 8 except the difference in the monitoring section. That is, in the voltage stabilizer 300 according to the third embodiment, the first monitoring section 311 generates the first monitor signal indicating a variation in the potential of the power supply line Vdd toward the high potential side and the second monitoring section 312 generates the second monitor signal indicating a variation toward the low potential side, whereas in the voltage stabilizer 400 according to this fourth embodiment, one monitoring section 410 shown in FIG. 12 generates both the first monitor signal and second monitor signal. Here, such a monitoring section 410 will be explained and explanations of the first current control section 420 and second current control section 430 shown in FIG. 12 will be omitted.

Figure 13:
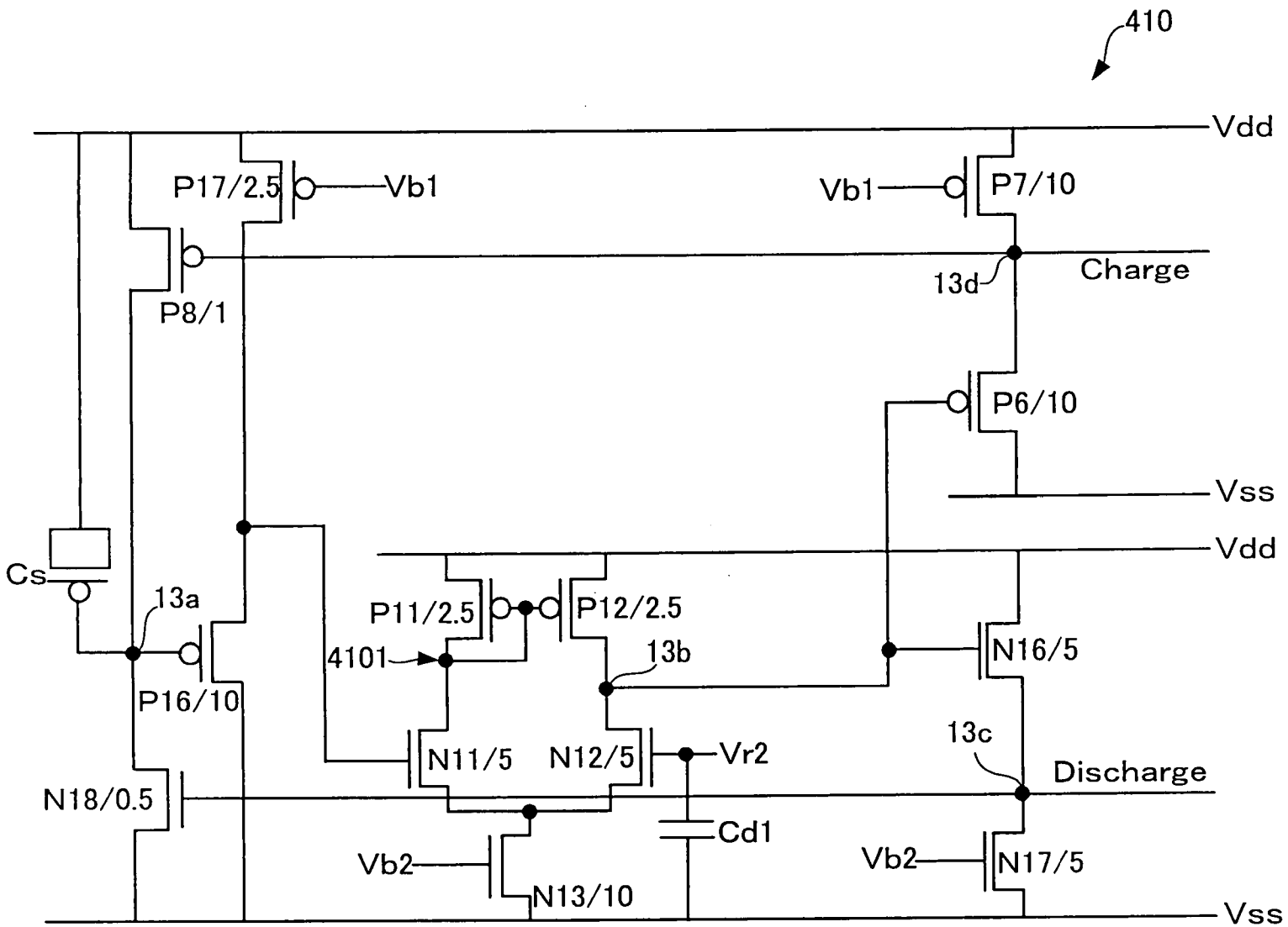
FIG. 13 is a circuit diagram of a monitoring section provided for the voltage stabilizer according to the fourth embodiment.

FIG. 13 is a circuit diagram of the monitoring section provided for the voltage stabilizer according to the fourth embodiment.

The monitoring section 410 shown in this FIG. 13 generates two signals; the discharge signal and charge signal explained using FIG. 12. The circuit structure of such a monitoring section 410 is the same as the circuit structure of the monitoring section 110 shown in FIG. 4 except that the potential of the node 4*d* shown in FIG. 4 of the monitoring section 110 provided for the voltage stabilizer 100 according to the first embodiment is output as a charge signal.

In the monitoring section 410 shown in FIG. 13, the voltage indicating a voltage variation in the power supply line Vdd detected by the capacitor Cs is applied to a node 13*a*. When the potential of the node 13*a* changes toward the high potential side, the potential of a node 13*b* of a differential amplifier 4101 increases and the potential of a node 13*c* also increases. Furthermore, in response to the increase in the potential of the node 13*b*, the potential of a node 13*d* also increases. On the contrary, when the potential of the node 13*a* changes toward the low potential side, the circuit operation of this monitoring section 410 becomes opposite to the operation when the potential of the node 13*a* changes toward the high potential side and the potential of the node 13*c* as well as the potential of the node 13*d* decreases. The potential of the node 13*c* is output as a discharge signal and the potential of the node 13*d* is output as a charge signal.

The voltage stabilizer 400 of the fourth embodiment can further reduce the size of the monitoring section 410 compared to the voltage stabilizer 300 of the third embodiment and further reduce the mounting area on the semiconductor substrate.

Next, the current stabilizer according to a fifth embodiment of the present invention will be explained.

Figure 14:
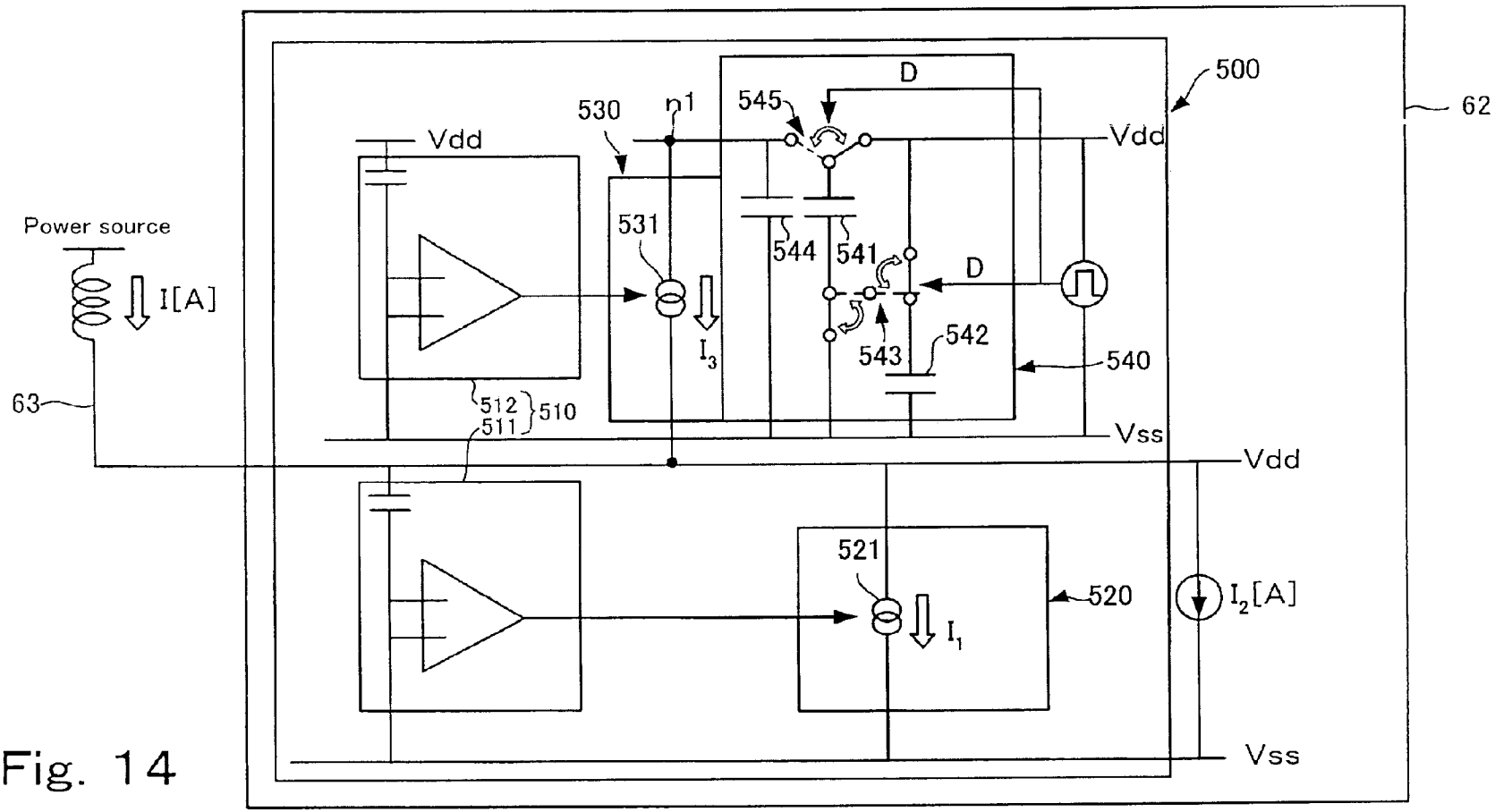
FIG. 14 schematically illustrates a voltage stabilizer according to a fifth embodiment.

FIG. 14 schematically illustrates the voltage stabilizer according to the fifth embodiment.

The voltage stabilizer 500 according to the fifth embodiment shown in FIG. 14 replaces the high potential line Vdd2 provided for the voltage stabilizer 300 of the third embodiment shown in FIG. 8 with a charge pump 540 and other components are the same as the components of the voltage stabilizer 300 of the third embodiment. That is, the voltage stabilizer 500 shown in FIG. 14 is provided with a monitoring section 510 including a first monitoring section 511 and a second monitoring section 512, a first current control section 520 and a second current control section 530. The charge pump 540 shown in FIG. 14 is provided with two sub capacitors 541, 542, a first changeover switch 543, one main capacitor 544 and a second changeover switch 545. The two sub capacitors 541, 542 are switched by the first changeover switch 543 and the second changeover switch 545 between a parallel state (see the first changeover switch 543 and second changeover switch 545 indicated by solid lines) in which they are connected in parallel between the power supply line Vdd and ground line Vss, and a serial state (see the first changeover switch 543 and second changeover switch 545 indicated by dotted lines) in which they are connected in series between a node n1 and ground line Vss as indicated by arrows in the figure. When the two sub capacitors 541, 542 are in the parallel state, power from the power supply line Vdd is charged into the sub capacitors 541, 542. The main capacitor 544 is connected between the node n1 and ground line Vss, and when the two sub capacitors 541, 542 are in the serial state, the power from the power supply line Vdd is boosted and a boosted current is charged into the main capacitor 544 this time. A frequency division clock signal generated by dividing a clock signal used for the semiconductor apparatus provided with this semiconductor substrate 62 is input (see arrow D) to both the first changeover switch 543 and second changeover switch 545 and both the changeover switches 543, 545 switch in synchronization with the frequency division clock signal.

As with the first current control section 320 shown in FIG. 8, the first current control section 520 is provided with a current source 521, generates a current signal corresponding to a first monitor signal input and passes a current $I_1$ which is an amplified current of the current signal generated from the power supply line Vdd through the current source 521. Furthermore, the second current control section 530 includes a current source 531 connected between the node n1 and power supply line Vdd. When the second current control section 530 receives a second monitor signal, it generates a current signal corresponding to the second monitor signal and passes a current $I_3$ which is an amplified current of the current signal generated from the node n1 to the power supply line Vdd through the current source 531.

As with FIG. 8, this FIG. 14 also illustrates a power supply path 63 that supplies power from a power supply to the power supply line Vdd of the semiconductor substrate 62 in which a load circuit (not shown) is incorporated. A current I flows through the power supply path 63 and a current $I_2$ flows through the load circuit (not shown).

Here, the operation of this voltage stabilizer 500 will be explained using FIG. 14 and FIG. 15.

Figure 15:
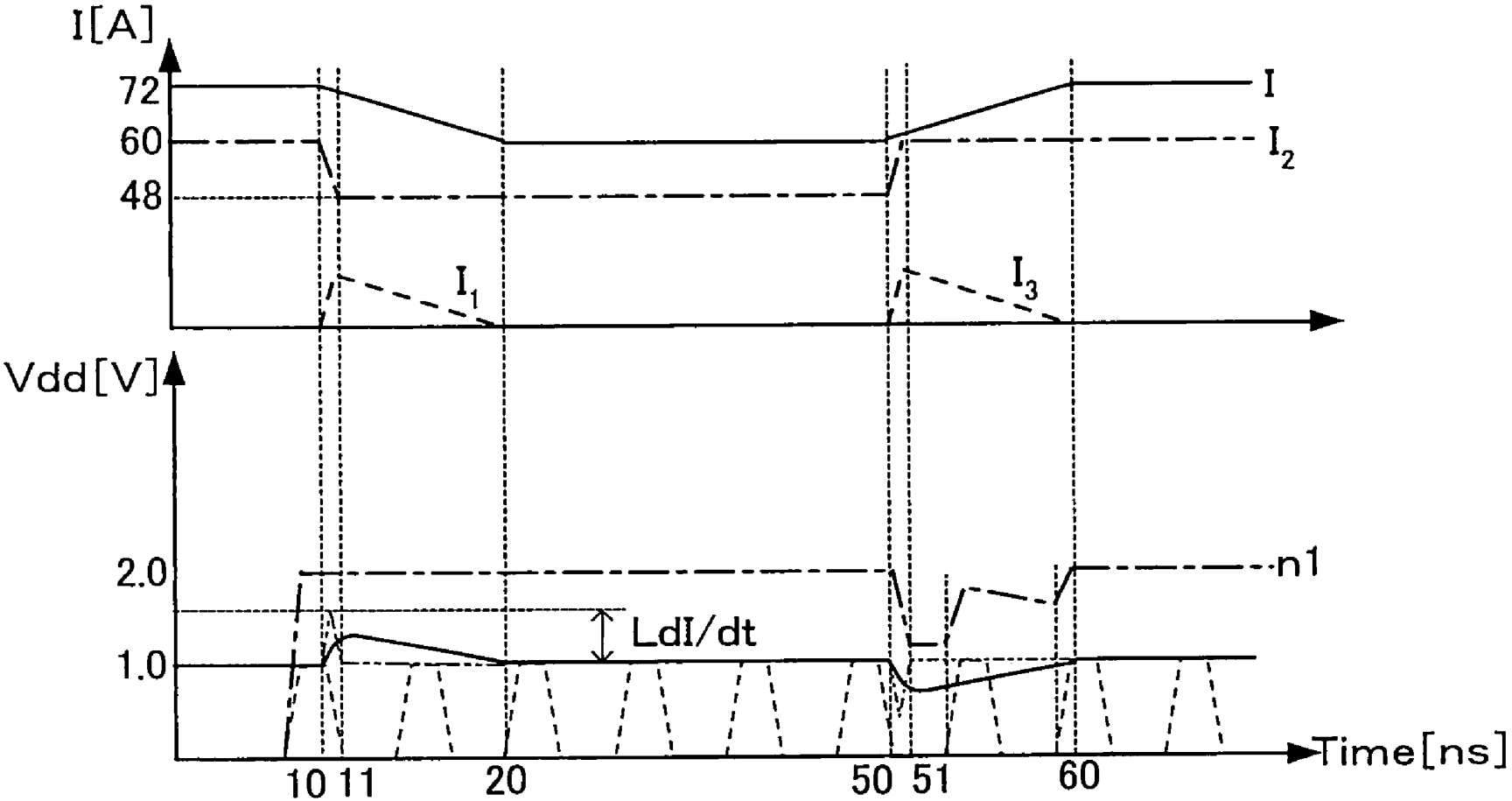
FIG. 15 is a timing chart showing a current variation in the power supply path shown in FIG. 14 and a voltage variation of the power supply line.

FIG. 15 is a timing chart showing a current variation in the power supply path and a voltage variation in the power supply line shown in FIG. 14.

This FIG. 15 shows two graphs up and down similar to the timing chart in FIG. 9 used in the explanation of the voltage stabilizer 300 according to the third embodiment. The graph shown on the upper row in FIG. 15 is a graph indicating a current variation in the power supply path 63 shown in FIG. 14. The dotted line shown on this upper graph shows both a variation in the amount of current $I_1$ passed by the first current control section 520 from the power supply line Vdd and a variation in the amount of current $I_3$ passed by the second current control section 530 from the node n1 into the power supply line Vdd. Below this graph, a graph is shown indicating a voltage variation of the power supply line Vdd shown in FIG. 14. In this graph below, a graph indicating a voltage variation at the node n1 shown in FIG. 14 is also shown with a single-dot dashed line. Furthermore, the above described frequency division clock signal is shown with a dotted line using the time axis (horizontal axis) of the graph below.

Since the operations of the first current control section 520 and second current control section 530 shown in FIG. 15 are the same as the operations of the first current control section 320 and second current control section 330 shown in FIG. 8, the operation of the charge pump 540 shown in FIG. 15 will be principally explained. When the two sub capacitors 541, 542 shown in FIG. 14 are in a serial state, the power from the power supply line Vdd is boosted. When the boosted power is charged into the main capacitor 544, the potential of the node n1 shown in FIG. 14 becomes higher than the potential of the power supply line Vdd. On the other hand, when the current $I_3$ is passed from the node n1, the potential of the node n1 decreases. In the explanation here, suppose the main capacitor 544 shown in FIG. 14 is initially fully discharged and the potential of the node n1 is 0 V. On the other hand, suppose the two sub capacitors 541, 542 shown in FIG. 14 are both initially fully charged. The first changeover switch 543 and second changeover switch 545 shown in FIG. 14 change the two sub capacitors 541, 542 from the parallel state to the serial state in synchronization with a rise of a pulse signal making up the frequency division clock signal and return them to the parallel state again. That is, at the timing at which the pulse signal increases, the two sub capacitors 541, 542 boost the power from the power supply line Vdd. After boosting the power from the power supply line Vdd, these sub capacitors 541, 542 are charged until the next rise of the pulse signal. Here, the potential of the node n1 increases up to a potential of 2.0 V which is higher than the potential of the power supply line Vdd at the first rise of the pulse signal making up the frequency division clock signal.

When the current $I_2$ flowing through the load circuit (not shown) incorporated in the semiconductor substrate 62 decreases from 60 A to 48 A, the potential of the power supply line Vdd increases and the first current control section 520 starts to pass the current $I_1$ from the power supply line Vdd, but the second current control section 530 continues to stop the passage of the current $I_3$ from the main capacitor 544 to the power supply line Vdd. The potential of the node n1 remains 2.0 V, and therefore the main capacitor 544 does not accept the charging of the boosted power and the two sub capacitors 541, 542 do not accept the charging from the power supply line Vdd, either. When the current variation in the power supply path 63 stops, the first current control section 520 stops the passage of the current $I_1$ from the power supply line Vdd at the moment of this stoppage. Then, when the current $I_2$ flowing through the load circuit returns from 48 A to 60 A, the voltage of the power supply path 63 decreases. The first current control section 520 continues to stop the passage of the current $I_1$ from the power supply line Vdd, but the second current control section 530 starts to pass the current $I_3$ from the main capacitor 544 to the power supply line Vdd (see the dotted line in the upper graph in FIG. 15). For this reason, the potential of the node n1 which has been 2.0 V so far decreases, but in synchronization with the first rise of the pulse signal after the potential of the node n1 starts to decrease, the boosted power is charged into the main capacitor 544. The second current control section 530 continues to pass the current $I_3$ from the charge pump 540 to the power supply line Vdd and even when the boosted power is charged into the main capacitor 544, the potential of the node n1 does not reach 2.0 V. The second current control section 530 still continues to pass the current 3 at the next (second) rise of the pulse signal and the potential of the node n1 gradually decreases until that time point. Then, in synchronization with the next rise of the pulse signal, when the boosted power is charged into the main capacitor 544 again, the potential of the node n1 reaches 2.0 V and the second current control section 530 completes the passage of the current $I_3$ just at this time point.

The voltage stabilizer 500 according to this fifth embodiment incorporates the charge pump 540 in the semiconductor substrate 62 and thereby eliminates the necessity for providing a high potential line Vdd2 for the semiconductor substrate 62 in addition to the power supply line Vdd as with the voltage stabilizers 300 and 400 of the third embodiment and fourth embodiment.

Next, the current stabilizer according to a sixth embodiment of the present invention will be explained.

Figure 16:
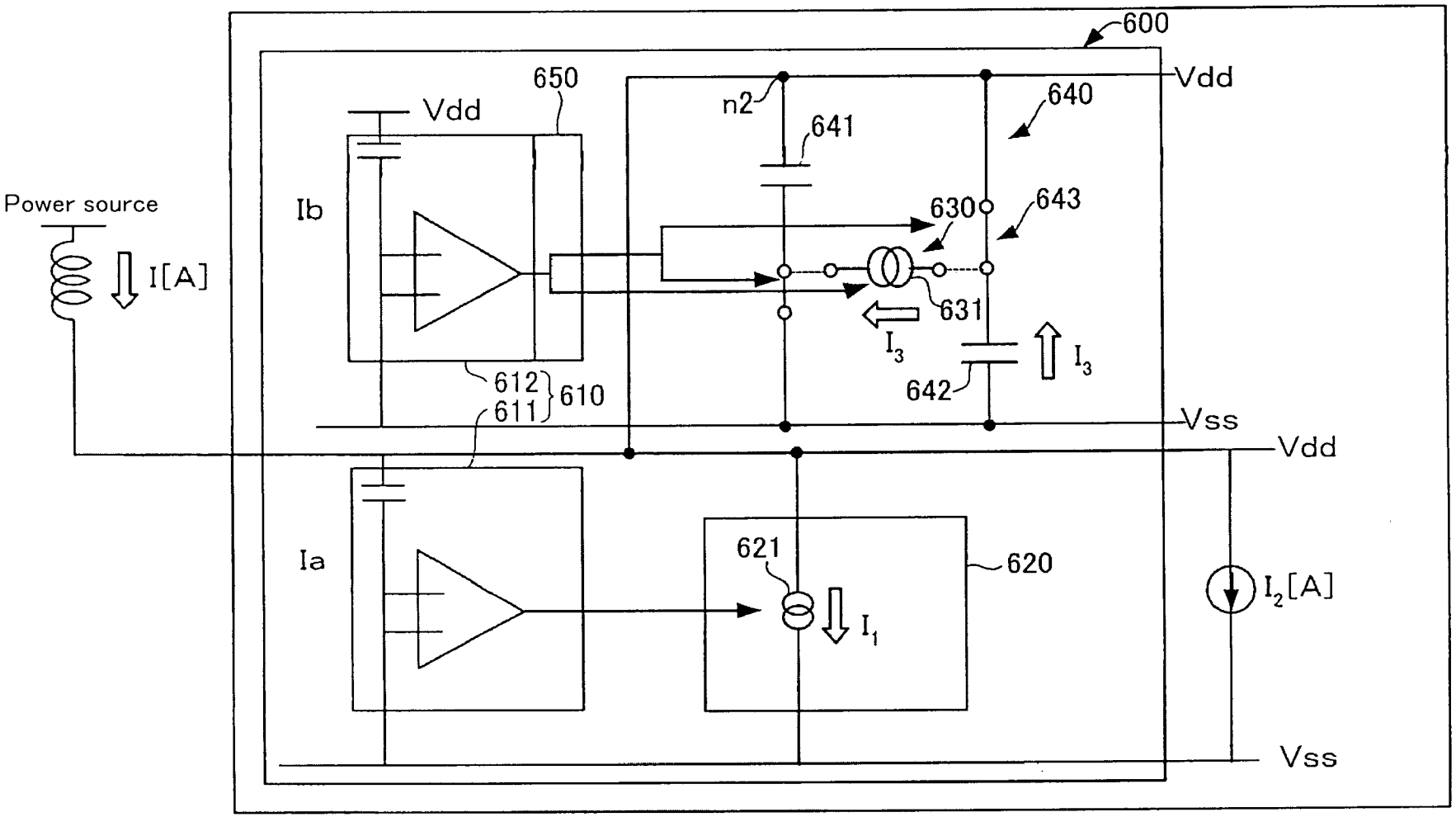
FIG. 16 schematically illustrates a voltage stabilizer according to a sixth embodiment.

FIG. 16 schematically illustrates the voltage stabilizer according to the sixth embodiment.

The voltage stabilizer 600 according to the sixth embodiment shown in FIG. 16 corresponds to the voltage stabilizer 500 according to the fifth embodiment shown in FIG. 14 with the charge pump 540 replaced by a charge pump 640 which has a structure different from the structure of the charge pump 540. Furthermore, the voltage stabilizer 600 according to the sixth embodiment is provided with a monitoring section 610 including a first monitoring section 611 and a second monitoring section 612, a first current control section 620 and a second current control section 630, and is further provided with a monitor signal branch section 650.

Unlike the charge pump 540 provided for the voltage stabilizer 500 according to the fifth embodiment, the charge pump 640 shown in FIG. 16 does not have any capacitor corresponding to the main capacitor 544 shown in FIG. 14. That is, the charge pump 640 shown in this FIG. 16 is constructed of two capacitors 641, 642 and a changeover switch 643. The connection state of the two capacitors 641, 642 shown in FIG. 16 is switched by the changeover switch 643 between a parallel state (see the changeover switch 643 indicated by a solid line) in which they are connected in parallel between the power supply line Vdd and ground line Vss, and a serial state (see the changeover switch 643 indicated by a dotted line) in which they are connected in series. When these two capacitors 641, 642 are in the parallel state, power from the power supply line Vdd is charged into these two capacitors 641, 642 and when these two capacitors 641, 642 are in the serial state, power from the power supply line Vdd is boosted and the potential of a node n2 becomes higher than the potential of the power supply line Vdd.

The first monitoring section 611 shown in FIG. 16 generates a first monitor signal indicating a variation in the voltage of the power supply line Vdd toward the high potential side. The first monitor signal generated is input to the first current control section 620. Furthermore, the second monitoring section 612 shown in FIG. 16 generates a second monitor signal indicating a variation in the voltage of the power supply line Vdd toward the low potential side. The second monitor signal generated is sent to the monitor signal branch section 650. The monitor signal branch section 650 generates a current control signal based on the second monitor signal and sends the current control signal to the second current control section 630 and generates a connection state changeover signal based on the second monitor signal and transmits the connection state changeover signal to the charge pump 640. This connection state changeover signal is a signal for switching the connection state of the two capacitors 641, 642 making up the charge pump 640 between the serial state and the parallel state and these two capacitors 641, 642 switch the connection state according to the connection state changeover signal.

As with the first current control section 520 shown in FIG. 14, the first current control section 620 shown in FIG. 16 is provided with a current source 621, passes a current $I_1$ which is an amplified current of the current signal corresponding to the first monitor signal input from the power supply line Vdd through the current source 621. Furthermore, the second current control section 630 includes a current source 631 connected between the two capacitors 641, 642 when connected in series between the power supply line Vdd and ground line Vss. The second current control section 630 amplifies a current based on the current control signal sent from the monitor signal branch section 650 and the current source 631 passes the amplified current $I_3$ from the node n2 into the power supply line Vdd.

Figure 17:
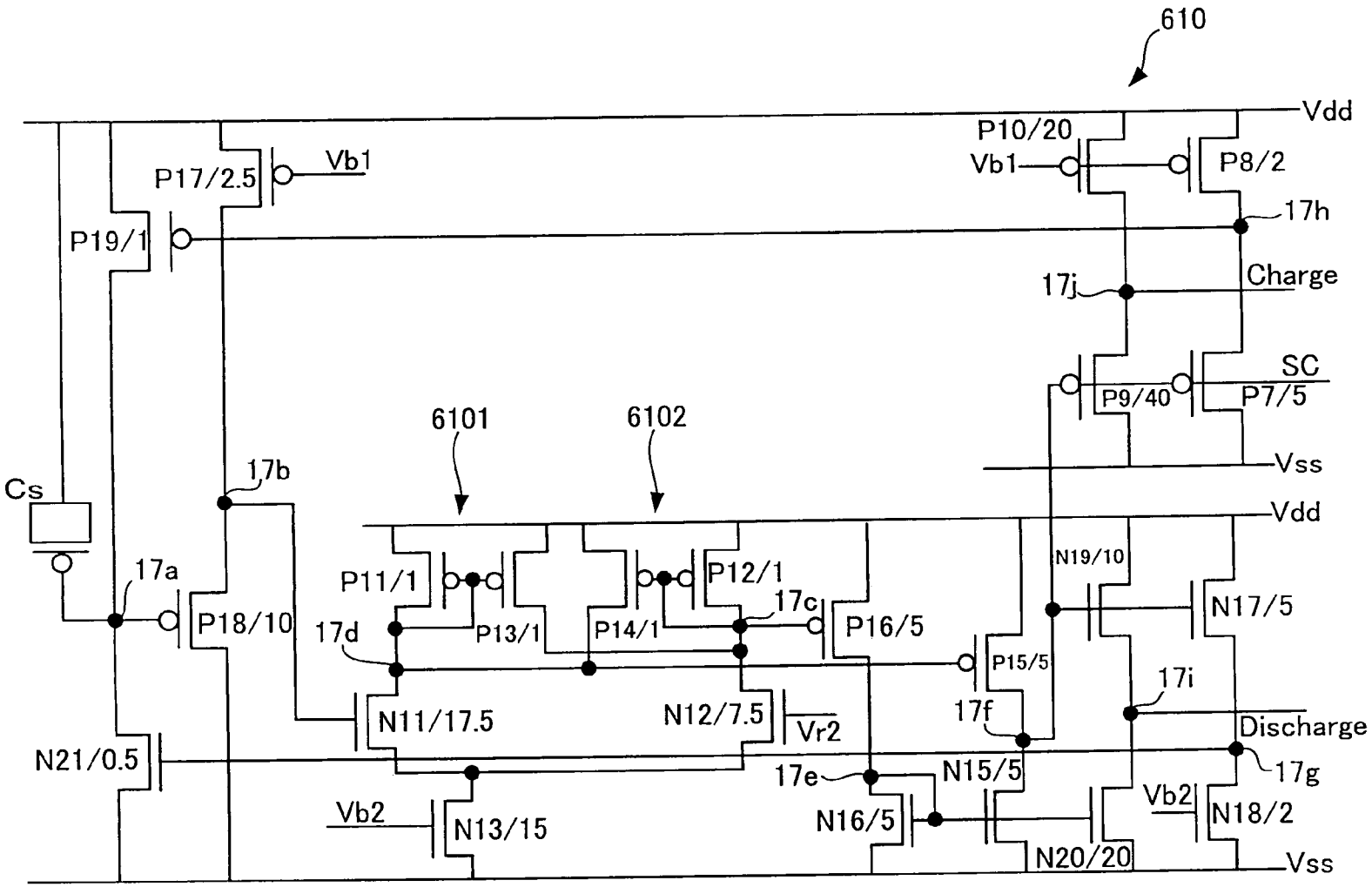
FIG. 17 is a circuit diagram of a monitoring section provided for the voltage stabilizer according to the sixth embodiment.

FIG. 17 is a circuit diagram of the monitoring section and the monitor signal branch section provided for the voltage stabilizer according to the sixth embodiment.

The circuit shown in FIG. 17 includes eight pairs of two MOS transistors connected in series between the power supply line Vdd and ground line Vss. These are seven pairs of MOS transistors; a pair of PMOS transistor 19 and NMOS transistor 21, a pair of PMOS transistor 17 and PMOS transistor 18, a pair of PMOS transistor 16 and NMOS transistor 16, a pair of PMOS transistor 15 and NMOS transistor 15, a pair of NMOS transistor 19 and NMOS transistor 20, a pair of NMOS transistor 17 and NMOS transistor 18, a pair of PMOS transistor 10 and PMOS transistor 9 and a pair of PMOS transistor 8 and PMOS transistor 7. A node 17*a* at which the PMOS transistor 19 and NMOS transistor 21 are connected is connected to the power supply line Vdd via a capacitor Cs and also connected to the gate of the PMOS transistor 18.

Furthermore, the circuit shown in this FIG. 17 is provided with two differential amplifiers; a first differential amplifier 6101 and a second differential amplifier 6102. The voltage of a node 17*b* at which the PMOS transistor 17 and PMOS transistor 18 are connected is input to the gate of the NMOS transistor 11 making up the first differential amplifier 6101. Furthermore, one end of the NMOS transistor 11 is connected to one end of the NMOS transistors 12, 13. The other end of the NMOS transistor 13 is connected to the ground line Vss. Furthermore, each of the other ends of the NMOS transistors 11, 12 is connected to the power supply line Vdd via the PMOS transistors 11, 13, respectively. Furthermore, the other end of the NMOS transistor 11 is also connected to each gate of the PMOS transistors 11, 13, which constitutes a current mirror circuit made up of the PMOS transistors 11, 13.

Furthermore, all the three NMOS transistors 11, 12, 13 that constitute the first differential amplifier 6101 also constitute the second differential amplifier 6102 and each of one ends (source) of the NMOS transistors 11, 12 is connected to the power supply line Vdd via the PMOS transistors 14, 12, respectively. Furthermore, one end of the NMOS transistor 12 is also connected to each gate of the PMOS transistors 14, 12, which constitutes a current mirror circuit made up of the PMOS transistors 14, 12.

Here, the semiconductor substrate 62 shown in FIG. 16 also incorporates the above described predetermined voltage generation circuit 700 shown in FIG. 5. A reference voltage Vr generated by this predetermined voltage generation circuit 700 is input to the gate of the NMOS transistor 12 and a low bias voltage Vb2 is input to the gate of the NMOS transistor 13. The low bias voltage Vb2 is also input to the gate of the NMOS transistor 18. Furthermore, a high bias voltage Vb1 is input to each gate of the three PMOS transistors 8, 10, 17.

Furthermore, the gate of the PMOS transistor 16 is connected to a node 17*c* at which the NMOS transistor 12 and PMOS transistor 12 are connected and the gate of the PMOS transistor 15 is connected to a node 17*d* at which the NMOS transistor 11 and PMOS transistor 11 are connected. Furthermore, the gates of the NMOS transistors 15, 16 are commonly connected to a node 17*e* at which the PMOS transistor 16 and NMOS transistor 16 are connected and the gate of the NMOS transistor 20 is also connected thereto. Both gates of the two NMOS transistors 19, 17 are connected to a node 17*f* at which the PMOS transistor 15 and NMOS transistor 15 are connected and both gates of the two PMOS transistors 9, 7 are also connected thereto. Furthermore, the gate of the NMOS transistor 21 is connected to a node 17*g* at which the two NMOS transistors 17, 18 are connected and the gate of the PMOS transistor 19 is connected to a node 17*h* at which the two PMOS transistors 8, 7 are connected.

Next, the circuit operation of the circuit shown in FIG. 17 will be explained.

When the potential of the power supply line Vdd changes, a voltage indicating a voltage variation in the power supply line Vdd detected by the capacitor Cs is applied to the node 17*a*. When the potential of the node 17*a* changes toward the high potential side, the ON-resistance of the PMOS transistor 18 increases and the potential of the node 17*b* increases. Then, the potential of the node 17*d* decreases and the potential of the node 17*c* increases accordingly. Furthermore, in response to the potential increase of the node 17*c*, the ON-resistance of the PMOS transistor 14 increases and the potential of the node 17*d* further decreases. Thus, this monitoring section 110 applies positive feedback promoting a variation in the potential of the node 17*d* and thereby stabilizes the circuit operation. When the potential of the node 17*c* increases, the potential of the node 17*e* decreases and the potential of the node 17*f* increases. The potential of this node 17*f* is output as a connection state changeover signal (SC). Furthermore, due to a variation in the potential of the node 17*e* toward the low potential side and a variation in the potential of the node 17*f* toward the high potential side, the potential of a node 17*i* increases. The potential of this node 17*i* is output as a discharge signal. On the other hand, when the potential of the node 17*f* increases, the potential of the node 17*j* also increases and the potential of this node 17*j* is output as a charge signal. The charge signal corresponds to a current control signal generated by the monitor signal branch section 650 shown in FIG. 16 and the PMOS transistor 9 corresponds to the monitor signal branch section 650 shown in FIG. 16.

Furthermore, when the potential of the node 17*f* increases, the ON-resistance of the NMOS transistor 17 decreases and the potential of the node 17*g* also increases and the ON-resistance of the NMOS transistor 21 also decreases. Furthermore, when the potential of the node 17*f* increases, the ON-resistance of the PMOS transistor 17 increases and the potential of the node 17*h* also increases and the ON-resistance of the PMOS transistor 19 also increases. Such a variation in the ON-resistance at the NMOS transistor 21 and PMOS transistor 19 decreases the potential of the node 17*a*. The circuit shown in this FIG. 17 has the function of restoring the increased potential of the power supply line Vdd to an original potential through such a circuit operation.

On the contrary, when the potential of the node 17*a* changes toward the low potential side, the circuit operation of this monitoring section 310 becomes opposite to the operation when the potential of the node 17*a* changes toward the high potential side and all the potentials of the three nodes 17*f*, 17*i*, 17*j* change toward the low potential side.

Next, the first current control section 620 provided for the voltage stabilizer according to the sixth embodiment shown in FIG. 16 will be explained using FIG. 18.

Figure 18:
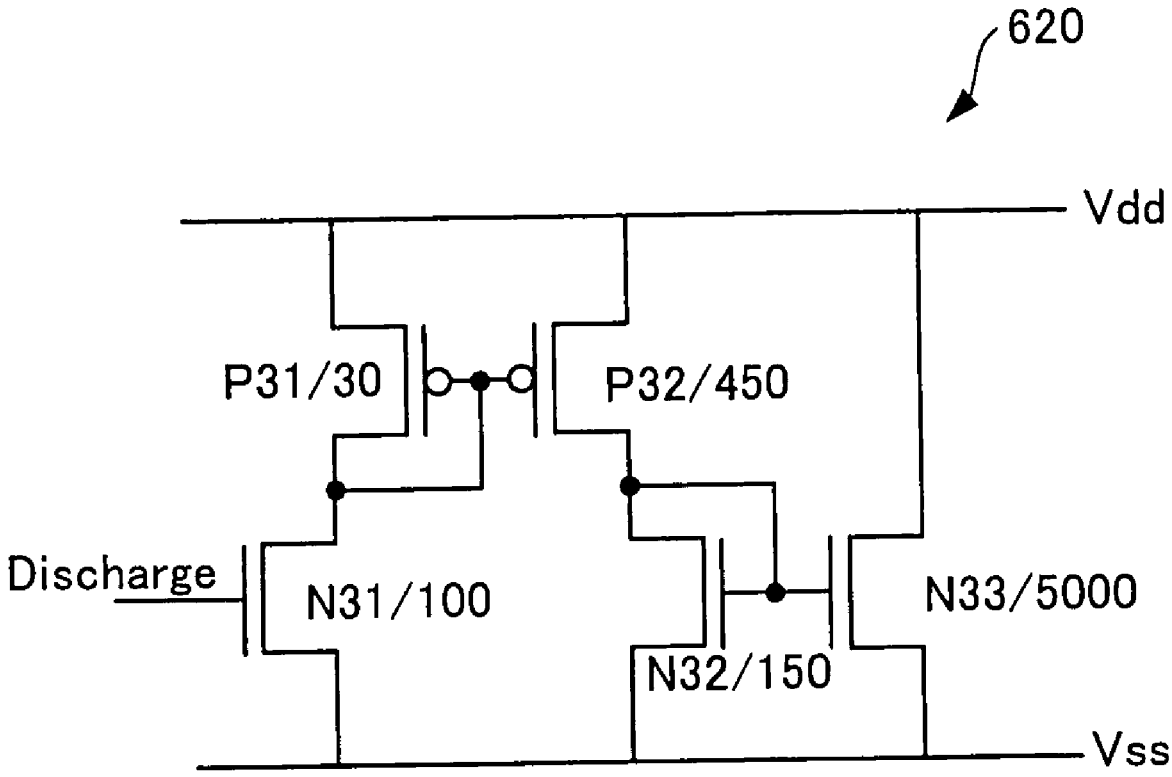
FIG. 18 is a circuit diagram of a first current control section provided for the voltage stabilizer according to the sixth embodiment.

FIG. 18 is a circuit diagram of a first current control section provided for the voltage stabilizer according to the sixth embodiment.

The circuit structure of the first current control section 620 shown in FIG. 18 is the same as the circuit structure of the current control section 120 provided for the voltage stabilizer 100 according to the first embodiment shown in FIG. 4 and here the circuit operation thereof will be explained in quite a simple manner. A discharge signal is input to the gate of the NMOS transistor 31. Here, when the discharge signal indicating the increased potential of the node 17*i* shown in FIG. 17 is input to the gate of the NMOS transistor 31, a current of the current signal corresponding to the discharge signal input is amplified in two stages and the current amplified in two stages flows out of the power supply line Vdd. On the other hand, when a discharge signal indicating the decreased potential of the node 17*i* is input to the gate of the NMOS transistor 31, the current flowing out of the power supply line Vdd decreases and when the voltage of the power supply line Vdd falls below the power supply voltage, the passage of the current from the power supply line Vdd stops. Therefore, the discharge signal indicating the increased potential of the node 17*i* corresponds to the first monitor signal generated by the first monitoring section 611 shown in FIG. 16.

Next, the second current control section 630 and charge pump 640 provided for the voltage stabilizer according to the sixth embodiment shown in FIG. 16 will be explained using FIG. 19.

Figure 19:
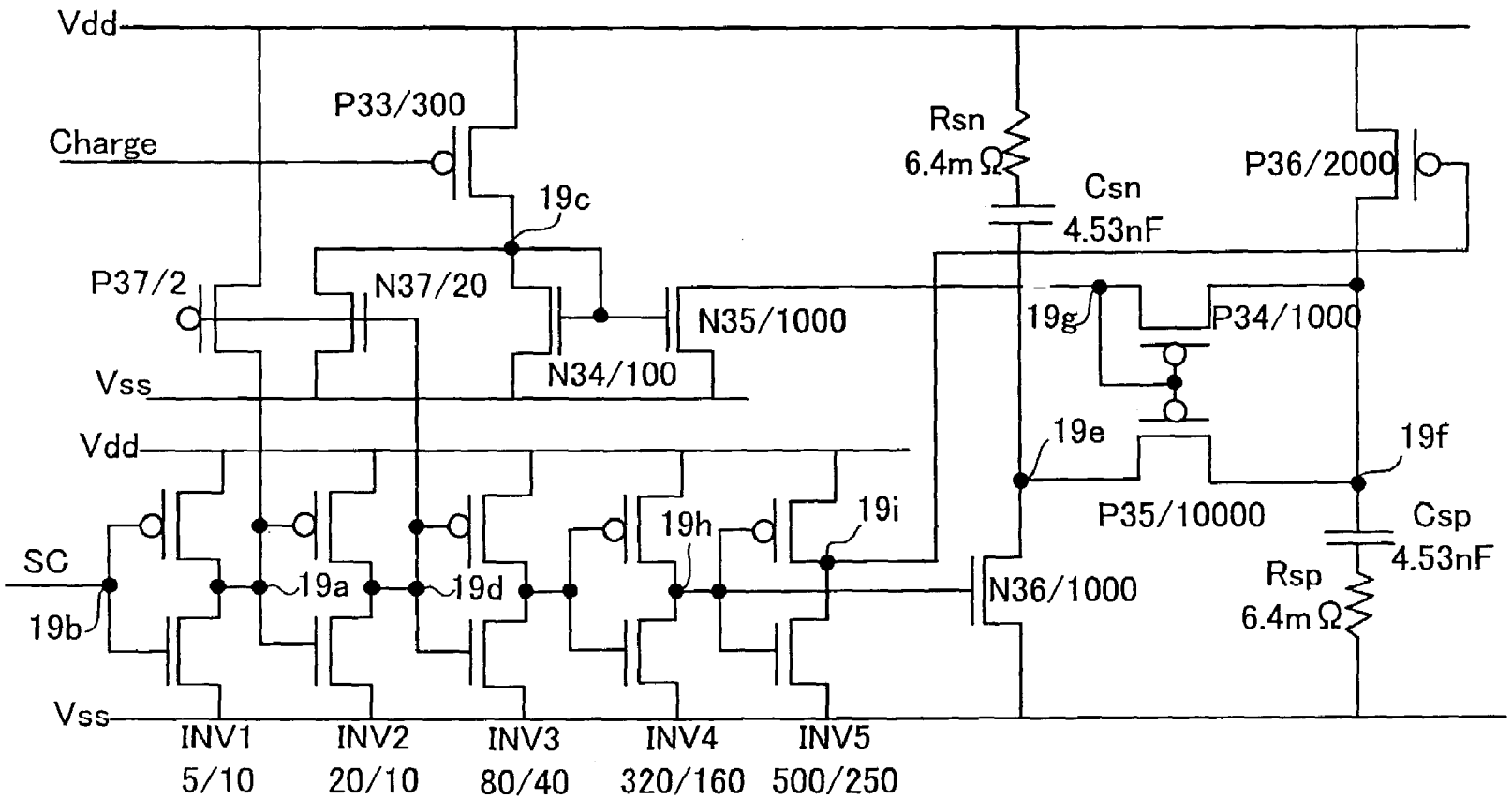
FIG. 19 is a circuit diagram of a second current control section and a charge pump provided for the voltage stabilizer according to the sixth embodiment.

FIG. 19 is a circuit diagram of the second current control section and the charge pump provided for the voltage stabilizer according to the sixth embodiment.

The circuit shown in this FIG. 19 is provided with five inverters between the power supply line Vdd and ground line Vss. All inverters are constructed of a PMOS transistor and an NMOS transistor and in this FIG. 19, each inverter is assigned an identification number as well as a relative transistor size. For example, "INV1 5/10" assigned to a first-stage inverter at bottom left in the figure indicates that it is an inverter having an identification number INV1 and the relative transistor size of the PMOS transistor making up this inverter is 5 and the size of the NMOS transistor is 10.

In the circuit shown in FIG. 19, a PMOS transistor 37 is connected between the power supply line Vdd and a node 19*a* at which both gates of a PMOS transistor and an NMOS transistor constituting a second-stage inverter INV2 are connected. Furthermore, a PMOS transistor 33 and an NMOS transistor 34 are connected in series between the power supply line Vdd and ground line Vss. In the circuit shown in FIG. 19, a charge signal is input to the gate of the PMOS transistor 33 and a connection state changeover signal is input to a node 19*b* at which both gates of the PMOS transistor and NMOS transistor constituting the first-stage inverter INV1 are connected. Furthermore, the circuit shown in FIG. 19 is provided with an NMOS transistor 35 whose one end is connected to the ground line Vss. A node 19*c* at which the PMOS transistor 33 and NMOS transistor 34 are connected is commonly connected to the gates of the two NMOS transistors 34, 35, which constitutes a current mirror circuit made up of the two NMOS transistors 34, 35. The transistor size of one NMOS transistor 35 constituting the current mirror circuit is 10 times the transistor size of the other NMOS transistor 34. An NMOS transistor 37 is connected between the node 19*c* and ground line Vss and the gate of this NMOS transistor 37 is connected to a node 19*d* at which both gates of the PMOS transistor and NMOS transistor constituting a third-stage inverter INV3 are connected. Furthermore, the gate of the PMOS transistor 37 is also connected to this node 19*d*. A resistor Rsn (resistance value 6.4 mΩ), a capacitor Csn (capacitance 4.53 nF) and an NMOS transistor 36 connected in series, and a PMOS transistor 36, a capacitor Csp (capacitance 4.53 nF) and a resistor Rsp (resistance value 6.4 mΩ) also connected in series are interposed between the power supply line Vdd and ground line Vss in parallel. A PMOS transistor 35 is connected between a node 19*e* at which the capacitor Csn and NMOS transistor 36 are connected and a node 19*f* at which the PMOS transistor 36 and capacitor Csp are connected. Furthermore, a PMOS transistor 34 is connected between the node 19*f* and a node 19*g* to which the source of the NMOS transistor 35 is connected. This node 19*g* is commonly connected to the gates of the two PMOS transistors 34, 35, which constitutes a current mirror circuit made up of the two PMOS transistors 34, 35. The transistor size of one PMOS transistor 35 constituting this current mirror circuit is 10 times the transistor size of the other PMOS transistor 34. Furthermore, the gate of the NMOS transistor 36 is connected to a node 19*h* at which a PMOS transistor and NMOS transistor constituting a fourth-stage inverter INV4 are connected and the gate of the PMOS transistor 36 is connected to a node 19*i* at which a PMOS transistor and NMOS transistor constituting a fifth-stage inverter INV5 are connected.

Next, the operation of the circuit shown in this FIG. 19 will be explained.

Here, as explained above, when the potential of the node 17*f* shown in FIG. 17 increases, both potentials of the node 17*i* and node 17*j* also increase and when the potential of the node 17*f* decreases, both potentials of the node 17*i* and node 17*j* also decrease. When the potential of the node 17*f* shown in FIG. 17 increases, a connection state changeover signal indicating the increased potential of the node 17*f* is input to the node 19*b* and a charge signal indicating the increased potential of the node 17*j* is input to the gate of the PMOS transistor 33.

Here, processing of the charge signal will be explained first. When the charge signal indicating the increased potential of the node 17*j* is input to the gate of the PMOS transistor 33, the ON-resistance of the PMOS transistor 33 increases and the potential of the node 19*c* decreases. Then, the ON-resistance of the NMOS transistor 35 also increases and the current that flows through this NMOS transistor 35 decreases.

Next, the processing of a connection state changeover signal will be described. When the connection state changeover signal indicating the increased potential of the node 17*f* is input to the node 19*b*, the potential of the node 19*a* decreases and the potential of the node 19*d* increases. In response to the increase in the potential of the node 19*d*, the ON-resistance of the NMOS transistor 37 decreases, while the ON-resistance of the PMOS transistor 37 increases. When the ON-resistance of the NMOS transistor 37 decreases, the potential of the node 19*c* further decreases and it is possible to suppress a leakage current which passes through the NMOS transistor 35 and decrease power consumption. That is, the NMOS transistor 37 promotes a variation in the current flowing through the NMOS transistor 35 which varies based on the charge signal. Furthermore, when the ON-resistance of the PMOS transistor 37 increases, the potential of the node 19*a* further decreases. The PMOS transistor 37 applies positive feedback which backs up the potential variation of the node 19*a* with a little delay based on the input connection state changeover signal. Such positive feedback allows the circuit shown in this FIG. 19 to have a hysteresis characteristic with respect to the input connection state changeover signal and perform a stable operation in response to the input connection state changeover signal. That is, the PMOS transistor 37 promotes a variation in the potential of the node 19*a* which varies based on the connection state changeover signal.

Here, when the charge signal indicating an increased potential is input, the potential of the node 19*g* increases and the current flowing through the two PMOS transistors 34, 35 decreases. On the other hand, when the connection state changeover signal indicating the increased potential is input, the potential of the node 19*h* increases and the potential of the node 19*i* decreases. When the potential of the node 19*h* increases, the current flowing through the NMOS transistor 36 increases, and when the potential of the node 19*i* decreases, the current flowing through the PMOS transistor 36 also increases. As a result, the connection state of the two capacitors Csn, Csp is changed to a state in which they are connected in parallel between the power supply line Vdd and ground line Vss.

On the contrary, when the charge signal indicating a decreased potential is input, the circuit shown in this FIG. 19 performs an operation opposite to the operation when the charge signal indicating an amount of increase in the potential is input. That is, the potential of the node 19*c* increases and the current flowing through the NMOS transistor 35 increases. This causes the potential of the node 19*g* to decrease and the current flowing through the PMOS transistor 35 to increase. On the other hand, because the connection state changeover signal indicating the decreased potential has been input, the potential of the node 19*h* decreases and the current flowing through the NMOS transistor 36 decreases. Furthermore, the potential of the node 19*i* increases and the current flowing through the PMOS transistor 36 also decreases. As a result, the connection state of the two capacitors Csn, Csp changes to a state in which the two capacitors are connected in series between the power supply line Vdd and ground line Vss and a current flows into the power supply line Vdd through the capacitor Csp→node 19*f*→PMOS transistor 35→node 19*e*→capacitor Csn. Here, due to the difference in transistor size between the two PMOS transistors 34, 35, the current flowing through this power supply line Vdd is amplified by the PMOS transistor 35.

According to the voltage stabilizer 600 of this sixth embodiment, as with the voltage stabilizer 500 of the fifth embodiment, the charge pump 640 incorporated in the semiconductor substrate 62 also eliminates the necessity for the high potential line Vdd2. Moreover, the voltage stabilizer 600 of this sixth embodiment eliminates the necessity for the main capacitor 544 provided for the voltage stabilizer 500 of the fifth embodiment and can further reduce the size compared to the voltage stabilizer 500 of the fifth embodiment. As a result, the voltage stabilizer 600 according to the sixth embodiment can further reduce the mounting area on the semiconductor substrate 62.

As has been explained using six embodiments so far, the voltage stabilizer of the present invention passes a current from the power supply line continuously according to a variation in the potential of the power supply line, and can thereby respond to an increase in the amount of current variation in the power supply line and follow up a variation speed of a speed-enhanced current in the power supply line. As a result, it is possible to stabilize the voltage in the power supply path connecting the power supply and semiconductor substrate. Moreover, since the voltage stabilizer in all the embodiments is constructed of transistors, etc., omitting capacitors having large areas, it is possible to reduce the mounting area on the semiconductor substrate. Furthermore, the voltage stabilizer of the present invention is not limited to the one that passes an amplified current from the power supply line, but passing the amplified current from the power supply line increases an equivalent capacitance and makes it possible to pass a high current from the power supply line at a time. This makes it easier to respond to an increase in a current variation on the power supply line and follow up the variation speed of the speed-enhanced current on the power supply line.

The invention claimed is:

1. A voltage stabilizer that stabilizes the voltage of a power supply line on a semiconductor substrate, comprising:

a monitoring section connected to the power supply line that monitors a potential of the power supply line and outputs a monitor signal indicating the monitoring result;

a first current control section that stabilizes the voltage of the power supply line by passing a current corresponding to the monitor signal from the power supply line, capable of freely passing a current continuously; and a high potential generation section that generates a high potential node having a predetermined high potential higher than the potential of the power supply line by boosting power from the power supply line, wherein the monitoring section comprises:

a first monitoring section that generates a first monitor signal indicating a variation toward the high potential side when the potential of the power supply line changes toward the high potential side; and a second monitoring section that generates a second monitor signal indicating a variation toward the low potential side when the potential of the power supply line changes toward the low potential side, the first current control section passes a current corresponding to the first monitor signal from the power supply line, and in addition to the first current control section, a second current control section that passes a current corresponding to the second monitor signal from the high potential node into the power supply line is provided.

2. The voltage stabilizer according to claim 1, wherein the high potential generation section comprises two capacitors between the power supply line and ground line to switch the connection state of the two capacitors between a serial connection between the power supply line and ground line and a parallel connection between the power supply line and ground line based on the monitor signal.

3. The voltage stabilizer according to claim 2, further comprising a monitor signal branch section that generates, based on the second monitor signal, a current control signal that controls a current to be passed by the second current control section from the high potential node into the power supply line, transmits the current control signal to the second current control section, and generates, based on the second monitor signal, a connection state changeover signal that switches the connection state of the two capacitors making up the high potential generation section and transmits the connection state changeover signal to the high potential generation section, wherein the second current control section comprises a variation promotion circuit that in response to a connection state changeover signal after being branched by the monitor signal branch section, promotes a variation of a current to be passed from the high potential node which varies based on the current control signal into the power supply line.

4. The voltage stabilizer according to claim 2, further comprising a monitor signal branch section that generates, based on the second monitor signal, a current control signal that controls a current to be passed by the second current control section from the high potential node into the power supply line, transmits the current control signal to the second current control section, and generates, based on the second monitor signal, a connection state changeover signal that switches the connection state of the two capacitors making up the high potential generation section and transmits the connection state changeover signal to the high potential generation section, wherein the high potential generation section comprises a changeover promotion circuit that in response to the current control signal after being branched by the monitor signal branch section, promotes a changeover speed of the connection state of the capacitors switched based on the connection state changeover signal.

* * * * *